US010688323B2

(12) United States Patent
Wolner et al.

(10) Patent No.: US 10,688,323 B2
(45) Date of Patent: Jun. 23, 2020

(54) SAFETY DEVICE WITH FALL ARREST AND DESCENDING MODES

(75) Inventors: J. Thomas Wolner, Red Wing, MN (US); Scott C. Casebolt, St. Paul Park, MN (US); Gabriel Grant Gamache, Cottage Grove, MN (US); Matthew J. Blackford, Hastings, MN (US); Vincent G. Meillet, Cannes la Bocca (FR); Joseph Robert Kaiser, Cottage Grove, MN (US)

(73) Assignee: D B INDUSTRIES, LLC, Maplewood, MN (US)

( * ) Notice: Subject to any disclaimer, the term of this patent is extended or adjusted under 35 U.S.C. 154(b) by 748 days.

(21) Appl. No.: 12/620,671

(22) Filed: Nov. 18, 2009

(65) Prior Publication Data

US 2010/0224448 A1 Sep. 9, 2010

Related U.S. Application Data

(63) Continuation-in-part of application No. 12/400,208, filed on Mar. 9, 2009, now Pat. No. 9,764,172.

(51) Int. Cl.
*A62B 1/10* (2006.01)

(52) U.S. Cl.
CPC ..... *A62B 1/10* (2013.01)

(58) Field of Classification Search
CPC ..... A62B 1/10; A62B 35/0093
USPC ... 182/231, 232, 234, 236, 237, 239, 71–73; 188/180, 184, 185, 188
See application file for complete search history.

(56) References Cited

U.S. PATENT DOCUMENTS

| | | | | |
|---|---|---|---|---|
| 157,660 A | | 12/1874 | Weston | |
| 523,874 A | | 7/1894 | Weston | |
| 659,093 A | | 10/1900 | Ockers | |
| 1,020,065 A | * | 3/1912 | Welsh | B66D 1/36 242/157.1 |

(Continued)

FOREIGN PATENT DOCUMENTS

| | | |
|---|---|---|
| CH | 364180 | 9/1958 |
| DE | 177841 | 3/1905 |

(Continued)

OTHER PUBLICATIONS

Modern Language Association (MLA): "sealed." Dictionary.com Unabridged. Random House, Inc. Jan. 16, 2012. <Dictionary.com http://dictionary.reference.com/browse/sealed>.*

(Continued)

*Primary Examiner* — Katherine W Mitchell
*Assistant Examiner* — Candace L Bradford

(57) ABSTRACT

A safety device with fall arrest and descending modes includes a housing, a drum, a lifeline, first and second brake assemblies, and a control. The drum is rotatably operatively connected to the housing. The lifeline has an intermediate portion interconnecting a first end and a second end. The first end is operatively connected to the drum. The first and second assemblies are operatively connected to the drum. The control is operatively connected to the first and second brake assemblies and has a first position and a second position. The first position selectively engages the first brake assembly in a descending mode and the second position selectively engages the second brake assembly in a fall arrest mode.

14 Claims, 17 Drawing Sheets

(56) References Cited

U.S. PATENT DOCUMENTS

| | | | | | |
|---|---|---|---|---|---|
| 1,363,749 | A | | 12/1920 | Peterson | |
| 1,724,713 | A | | 8/1929 | Johnston | |
| 1,950,289 | A | | 3/1934 | Benson | |
| 2,502,896 | A | | 4/1950 | Sherbrook et al. | |
| 2,680,593 | A | * | 6/1954 | McIntyre | A62B 1/10 182/231 |
| 2,776,815 | A | | 1/1957 | Sheard | |
| 2,809,804 | A | | 10/1957 | Sheard | |
| 3,081,839 | A | | 3/1963 | O'Brien | |
| 3,089,599 | A | | 5/1963 | Casella | |
| 3,101,927 | A | | 8/1963 | Gray | |
| 3,204,720 | A | | 9/1965 | Eitel | |
| 3,946,989 | A | * | 3/1976 | Tsuda | A62B 1/10 182/241 |
| 3,999,627 | A | | 12/1976 | Naka | |
| 4,018,423 | A | * | 4/1977 | Belew | A62B 1/12 182/238 |
| 4,125,142 | A | | 11/1978 | Fohl | |
| 4,253,545 | A | * | 3/1981 | Yui | A62B 1/10 182/240 |
| 4,421,209 | A | | 12/1983 | Vermette et al. | |
| 4,434,869 | A | | 3/1984 | Roop et al. | |
| 4,476,956 | A | | 10/1984 | Eger | |
| 4,487,292 | A | * | 12/1984 | Smith | A62B 1/10 182/234 |
| 4,577,725 | A | | 3/1986 | Hunter | |
| 4,589,519 | A | | 5/1986 | Hunter | |
| 4,589,523 | A | | 5/1986 | Olson et al. | |
| 4,598,792 | A | | 7/1986 | Lew et al. | |
| 4,598,793 | A | | 7/1986 | Lew et al. | |
| 4,623,038 | A | * | 11/1986 | Stancato | A62B 1/10 182/234 |
| 4,679,656 | A | | 7/1987 | Lew et al. | |
| 4,688,657 | A | | 8/1987 | Erickson | |
| 4,694,934 | A | | 9/1987 | Erickson | |
| 4,702,348 | A | | 10/1987 | Lew et al. | |
| 4,737,065 | A | | 4/1988 | Ju | |
| 4,793,436 | A | | 12/1988 | Lew et al. | |
| 4,830,340 | A | | 5/1989 | Knitig | |
| 4,877,110 | A | | 10/1989 | Wolner | |
| 4,938,435 | A | * | 7/1990 | Varner | A62B 1/08 182/231 |
| 5,076,395 | A | * | 12/1991 | Kikuchi | A62B 1/10 182/234 |
| 5,127,631 | A | * | 7/1992 | Flaig | B66D 1/54 182/239 |
| 5,186,289 | A | * | 2/1993 | Wolner | A62B 1/12 182/232 |
| 5,280,828 | A | * | 1/1994 | Reynoso | F16D 59/00 188/184 |
| 5,305,852 | A | | 4/1994 | Klokseth | |
| 5,343,976 | A | * | 9/1994 | Ostrobrod | A62B 1/06 182/237 |
| 5,447,280 | A | * | 9/1995 | Feathers | A62B 1/10 182/237 |
| 5,586,617 | A | * | 12/1996 | England | A62B 1/12 182/238 |
| 5,701,972 | A | * | 12/1997 | Bloder | A62B 1/10 182/234 |
| 5,829,548 | A | * | 11/1998 | Ostrobrod | E06O 7/18 182/18 |
| 5,878,855 | A | | 3/1999 | Miyata | |
| 5,927,438 | A | | 7/1999 | Ostrobrod | |
| 6,085,368 | A | | 7/2000 | Robert et al. | |
| 6,182,789 | B1 | * | 2/2001 | Okamura | A62B 1/02 182/7 |
| 6,182,791 | B1 | | 2/2001 | Cope | |
| 6,279,682 | B1 | * | 8/2001 | Feathers | A62B 35/0093 182/239 |
| 6,494,292 | B2 | | 12/2002 | Cope | |
| 6,550,597 | B2 | | 4/2003 | Taniguchi | |
| 7,097,005 | B2 | * | 8/2006 | Angermann | A62B 1/10 188/130 |
| 7,258,324 | B2 | | 8/2007 | Gilman | |
| 7,281,620 | B2 | | 10/2007 | Wolner et al. | |
| 7,845,467 | B2 | * | 12/2010 | Petzl | A62B 1/14 182/193 |
| 8,061,479 | B2 | * | 11/2011 | Harris, Jr. | A62B 35/0093 182/3 |
| 8,245,817 | B2 | * | 8/2012 | Casebolt | A62B 35/0093 182/231 |
| 2002/0179372 | A1 | * | 12/2002 | Schreiber | A62B 1/10 182/238 |
| 2004/0065508 | A1 | | 4/2004 | Avots et al. | |
| 2005/0051659 | A1 | | 3/2005 | Wolner et al. | |
| 2006/0113147 | A1 | | 6/2006 | Harris, Jr. | |
| 2007/0261921 | A1 | | 11/2007 | Gal et al. | |
| 2008/0128221 | A1 | | 6/2008 | Rogge | |
| 2009/0173578 | A1 | * | 7/2009 | Renton | A62B 1/14 182/235 |
| 2010/0282541 | A1 | * | 11/2010 | Renton | A62B 1/18 182/234 |
| 2011/0278095 | A1 | * | 11/2011 | Hetrich | A62B 1/10 182/231 |
| 2013/0248291 | A1 | * | 9/2013 | Jones | A62B 1/10 182/241 |
| 2014/0190770 | A1 | * | 7/2014 | Renton | A62B 1/10 182/239 |

FOREIGN PATENT DOCUMENTS

| | | | | | |
|---|---|---|---|---|---|
| DE | 2919216 | A1 | | 11/1980 | |
| DE | 19818688 | C1 | | 1/2000 | |
| DE | 10210969 | A1 | | 10/2003 | |
| DE | 202006020127 | U1 | | 11/2007 | |
| DE | 202007013135 | U1 | | 4/2008 | |
| FR | 2654940 | A1 | | 5/1991 | |
| GB | 2192679 | A | | 1/1938 | |
| GB | 999553 | A | | 7/1965 | |
| GB | 2 256 413 | A | | 12/1992 | |
| GB | 2256413 | A | * | 12/1992 | A62B 1/10 |
| GB | 2256413 | A | * | 12/1992 | A62B 1/10 |
| GB | 2 306 107 | A | | 4/1997 | |
| JP | S62-090177 | A | | 4/1987 | |
| JP | H08-131568 | A | | 5/1996 | |
| WO | WO 2006/094486 | A1 | | 9/2006 | |

OTHER PUBLICATIONS

Photographs of fall arrest block device, International Safety Components Ltd., Bangor, Gwynedd, United Kingdom, 11 pages (known of prior to filing of U.S. Appl. No. 12/400,208).

"Retrieval Instructions—To Engage and Disengage the Function Winch—Retractable Type Fall Arrester—AD515, EN360-EN1496 Classe B", Protecta® International, Carros, Cedex, France, 4 pages (known of prior to filing of U.S. Appl. No. 12/400,208).

User Instruction Manual Rollgliss® Rescue Emergency Descent Device with Manual Retract, High-Speed, DBI/SALA®, Form 5902152 Rev: A, 12 pages (© 2000 DB Industries, Inc.).

"User Instruction Manual Fisk Descender", DBI SALA®, Form 5902142 Rev: D, 36 pages (© 2002 DB Industries, Inc.).

Fiche technique, Tractel Group, 3 pages (© TRACTEL S.A.S. 2003).

User Instruction Manual for Rescue/Personnel Riding System Rollgliss R350, DBI/SALA®, Form 5902125 Rev: A, 28 pages (© 2004, DB Industries, Inc.).

"User Instruction Manual—Sealed Self Retracting Lifelines", DBI/SALA®, Form 5902122 Rev: G, 26 pages (© 2004—DB Industries, Inc.).

Protecta, Instructions for Use AD Series Self Retracting Lifelines, Form 5902290 Rev: F, 2 pages (© Protecta 2005).

"User Instruction Manual Rescumatic® Emergency Escape Device and Rescue Cradle", DBI SALA®, Form 5906277 Rev: F, 16 pages (© 2005, DB Industries, Inc.).

Fallstop® Safety, Bornack, pp. 55-64 (© Bornack 2007).

"Sealed Self Retracting Lifeline—Revolutionary Sealed Design Stands-Up to Even the Harshest Environments for Ultimate Safety and Reliability!", DBI/SALA®, 2 pages (© 2007—Capital Safety).

(56) References Cited

OTHER PUBLICATIONS

"User Instructions Manual Self Retracting Lifelines", DBI SALA®, 40 pages Form: 5902101C Rev: I (© 2007, DB Industries, Inc.).
Fall Arrest Block UB157, ISC (International Safety Components Ltd.), Bangor, Gwynedd, United Kingdom, 4 pages (Printed Sep. 14, 2007).
User Instruction Manual Rollgliss® Rescue Emergency Descent Device with Auto-Retract, DBI SALA®, Form No. 5902105 Rev. B, 16 pages (© 2008, DB Industries, Inc.).
Non-Final Office Action for corresponding U.S. Appl. No. 12/400,208, dated Jan. 3, 2012.
International Search Report for PCT/US2010/024896, 4 pages (dated Aug. 4, 2010).
Final Office Action for U.S. Appl. No. 12/400,208 dated May 2, 2014 (9 pgs.).
Examiner's Answer to Appeal Brief for U.S. Appl. No. 12/400,208 dated Dec. 23, 2014 (13 pgs.).
Restriction Requirement for U.S. Appl. No. 12/400,208 dated Sep. 6, 2011 (7 pages).
Notice of Allowance for U.S. Appl. No. 12/400,208 dated Jun. 14, 2017 (18 pages).

* cited by examiner

FIG. 2
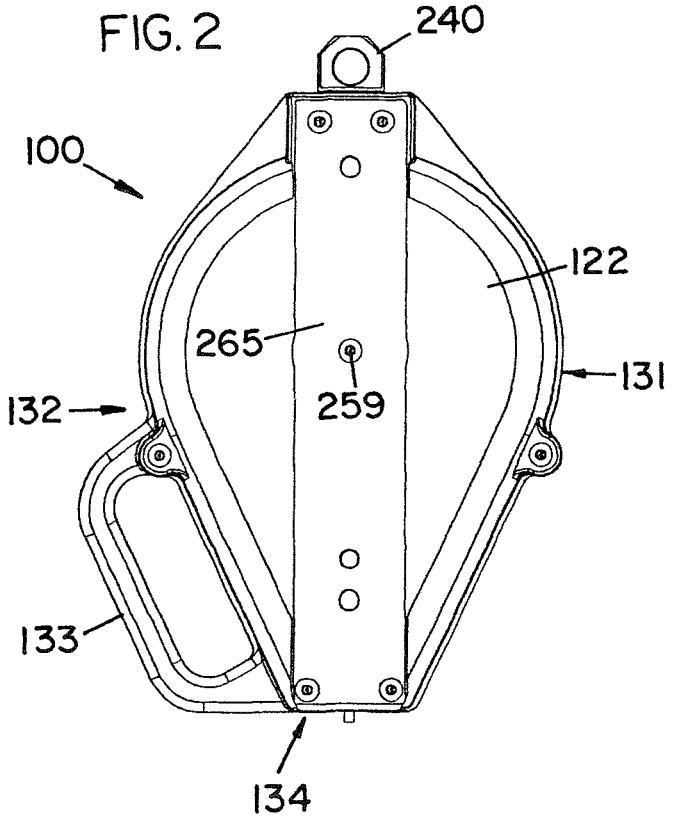
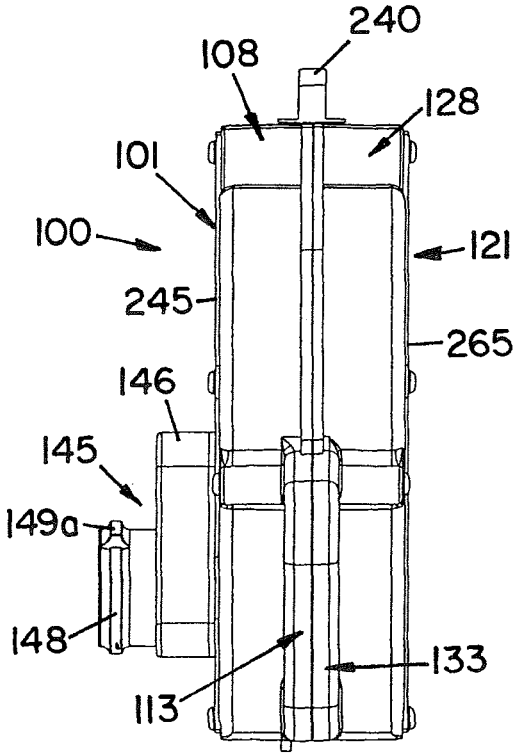
FIG. 3

FIG. 9
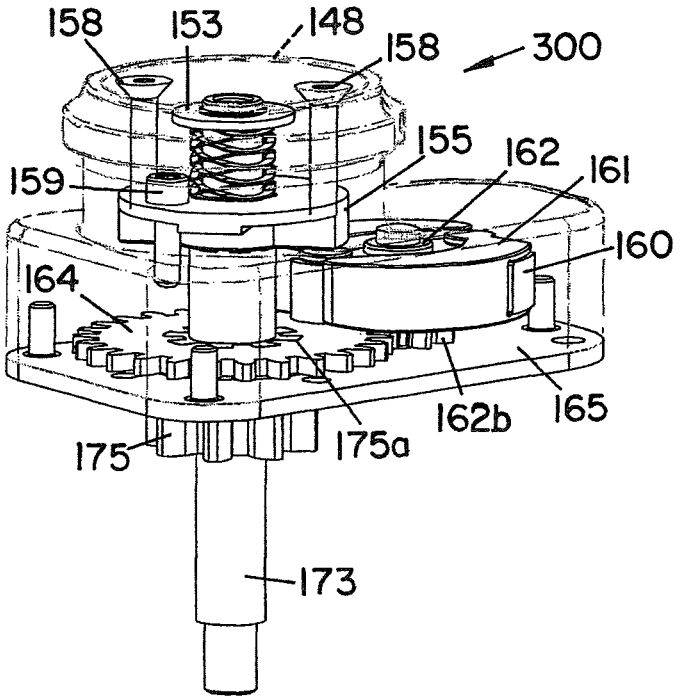
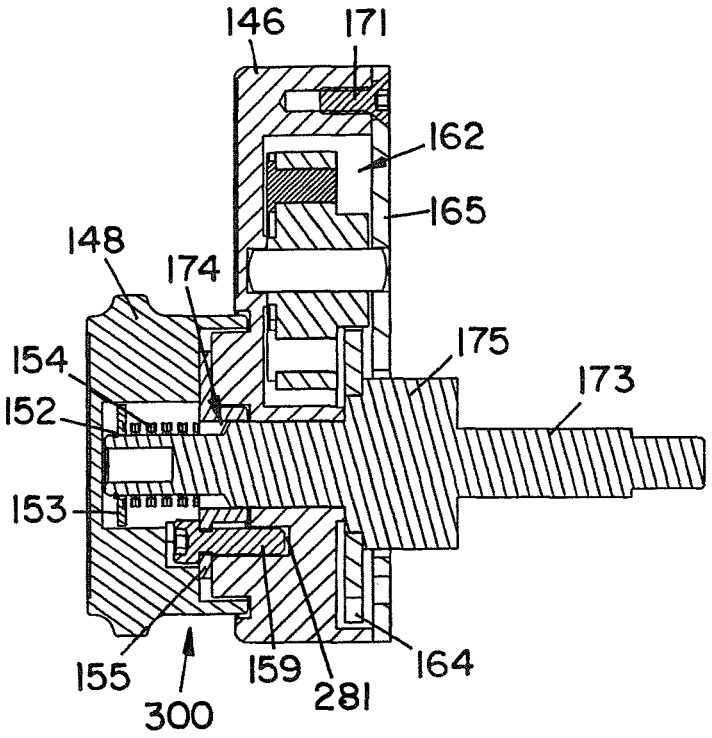
FIG. 10

SAFETY DEVICE WITH FALL ARREST AND DESCENDING MODES

This application is a continuation-in-part of U.S. patent application Ser. No. 12/400,208, filed Mar. 9, 2009.

FIELD OF THE INVENTION

The present invention relates to a safety device with fall arrest and descending modes.

BACKGROUND

Safety devices are well known in the art of fall protection safety equipment for use by workers performing tasks during which there is a risk a fall may occur. One type of safety device commonly used is a self-retracting lifeline, which is typically connected to a support structure within the vicinity the worker is performing the task, and the end of the cable is typically connected to a safety harness worn by the worker. Self-retracting lifelines generally include a housing containing a drum around which a cable, rope, or webbing is wound. The drum is spring biased to pay out cable as tension pulling the cable is applied and to retract any of the cable that has been unwound from the drum as the tension on the cable is reduced or released. The housing also includes a brake assembly for stopping rotation of the drum when the cable suddenly unwinds from the drum at a rate greater than a predetermined maximum angular velocity. As the rotation of the drum is stopped, additional cable is prevented from being paid out of the housing to stop the fall of the worker.

Should a fall occur, or should the worker need to otherwise be rescued, the worker may require assistance to reach safety. In such situations, another type of safety device, a controlled descent device, may be used to assist the worker to safety.

For the reasons stated above and for other reasons stated below, which will become apparent to those skilled in the art upon reading and understanding the present specification, there is a need in the art for a safety device with fall arrest and descending modes.

SUMMARY

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In an embodiment safety device having first and second operating modes, a housing has a first cavity and a second cavity in fluid communication via a bore interconnecting the first and second cavities. A drum is rotatably operatively connected to the housing within the second cavity. A lifeline has an intermediate portion interconnecting a first end and a second end. The first end is operatively connected to the drum. A shaft is operatively connected to the drum in the second cavity and extends through the bore and into the first cavity. A first brake assembly is operatively connected to the shaft, and a second brake assembly is operatively connected to the shaft. A control is operatively connected to the first and second brake assemblies and has a first position and a second position. The first position selectively engages the first brake assembly and the second position selectively engages the second brake assembly. The first cavity is sealed.

In an embodiment safety device with fall arrest and descending modes, a drum is rotatably operatively connected to a housing. A lifeline has an intermediate portion interconnecting a first end and a second end. The first end is operatively connected to the drum. A first brake assembly is operatively connected to the drum, and a second brake assembly is operatively connected to the drum. A control is operatively connected to the first and second brake assemblies and has a first position and a second position. The first position selectively engages the first brake assembly and the second position selectively engages the second brake assembly.

In an embodiment safety device with fall arrest and descending modes, a drum is rotatably operatively connected to a housing. A lifeline has an intermediate portion interconnecting a first end and a second end. The first end is operatively connected to the drum, at least a portion of the intermediate portion is wound about the drum, and the second end is operatively connected to a hook. A first brake assembly and a second brake assembly are operatively connected to the drum. The first brake assembly includes a rotor to which at least one first pawl having a friction pad is pivotally operatively connected and a first spur gear. The rotor includes a rotor gear. The first spur gear includes inner teeth and outer teeth. The second brake assembly includes a gear assembly and at least one second pawl. The gear assembly includes a second spur gear. A shaft includes first and second teeth and operatively connects the first and second brake assemblies. The inner teeth of the first spur gear mate with the first teeth of the shaft and the outer teeth mate with the rotor gear to interconnect the shaft and the rotor. The second spur gear mates with the second teeth of the shaft. A control is operatively connected to the shaft and has a first position and a second position. The first position allows the shaft to rotate and selectively engages the first brake assembly in a descending mode in which the friction pad contacts the housing when the rotor rotates. The second position locks the shaft and selectively engages the second brake assembly in a fall arrest mode in which the at least one second pawl is operatively connected to the drum and is configured and arranged to engage the gear assembly when the drum rotates at a predetermined speed.

BRIEF DESCRIPTION OF THE DRAWINGS

The present invention can be more easily understood, and further advantages and uses thereof can be more readily apparent, when considered in view of the detailed description and the following Figures in which:

FIG. 2 is a rear view of the safety device shown in FIG. 1;

FIG. 3 is a side view of the safety device shown in FIG. 1;

FIG. 9 is a perspective view of the control and the descending assembly in the fall arrest mode;

FIG. 10 is a cross-section view of the control and the descending assembly in the fall arrest mode;

In accordance with common practice, the various described features are not drawn to scale but are drawn to emphasize specific features relevant to the present invention. Reference characters denote like elements throughout the Figures and the text.

DETAILED DESCRIPTION OF A PREFERRED EMBODIMENT

Figure 1:
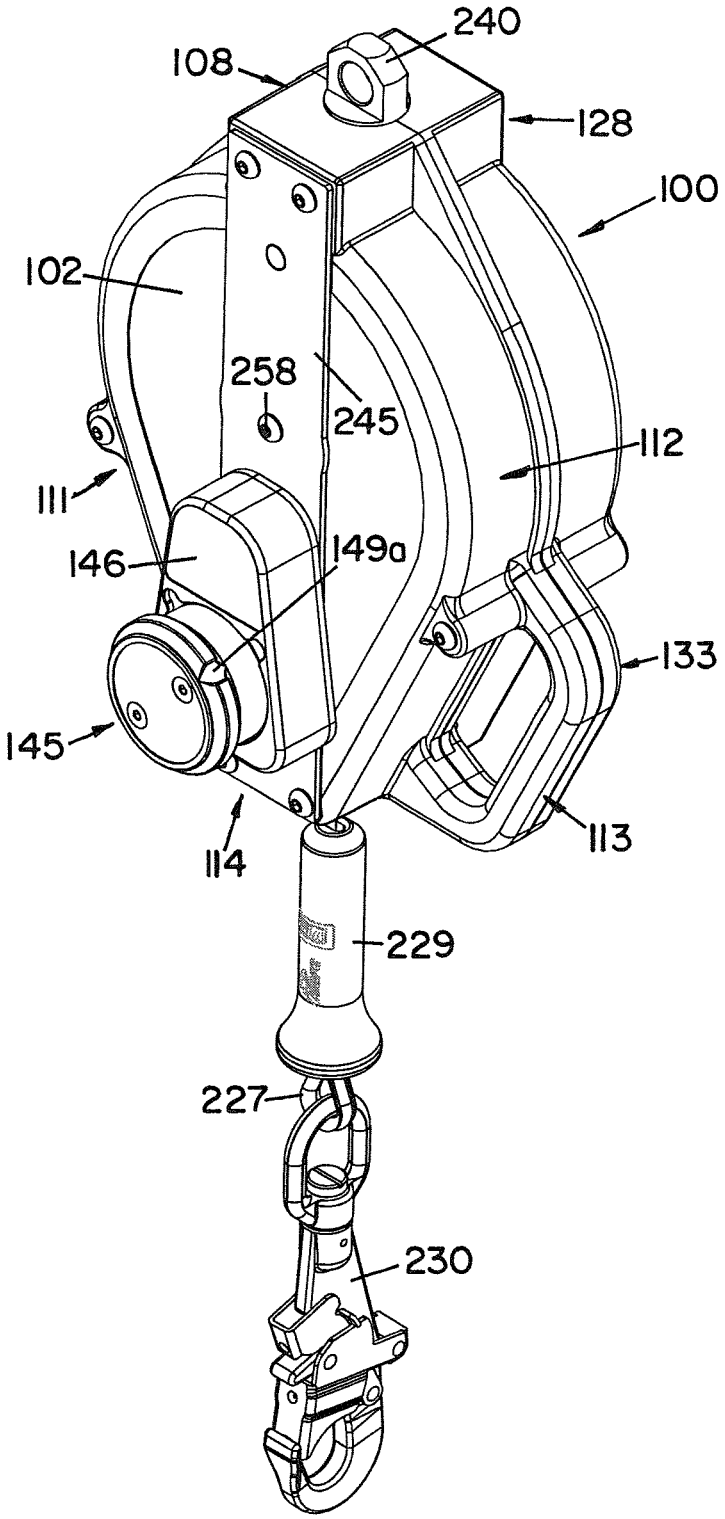
FIG. 1 is a front perspective view of a safety device with fall arrest and descending modes constructed according to the principles of the present invention.

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

One embodiment safety device constructed in accordance with the principles of the present invention is designated by the numeral 100 in the drawings. The safety device 100 includes a front housing portion 101 and a rear housing portion 121 that form a cavity in which some of the other components are housed. The front housing portion 101 includes a front plate 102, which includes a protrusion 103 proximate the top, a center aperture 104, a bottom opening 105 with apertures 106 proximate the sides and the bottom of the bottom opening 105, and bottom apertures 107 below the bottom opening 105. A top 108, a first side 111, a second side 112, and a bottom 114 extend outward from the front plate 102 to form a cavity (not shown) therebetween. The top 108 includes a notch or an opening 110 providing access to a cavity (not shown) configured and arranged to receive a portion of a swivel eye 240. The second side 112 includes a handle portion 113 proximate the middle and the bottom of the second side 112. The bottom 114 includes a notch or an opening 116 providing access to a cavity 117.

The rear housing portion 121 includes a rear plate 122, which includes a center aperture 124 and other apertures (not shown). A top 128, a first side 131, a second side 132, and a bottom 134 extend outward from the rear plate 122 to form a cavity 137. The top 128 includes a notch or an opening 130 providing access to a cavity 129 configured and arranged to receive a portion of the swivel eye 240. The second side 132 includes a handle portion 133 proximate the middle and the bottom of the second side 132. Within the cavity 137 proximate the bottom 134 is a partition 135 extending from the second side 132 to proximate the first side 131 with a gap between the partition 135 and the first side 131. The bottom 134 includes a notch or an opening 136 providing access to a cavity 138.

Figure 5A:
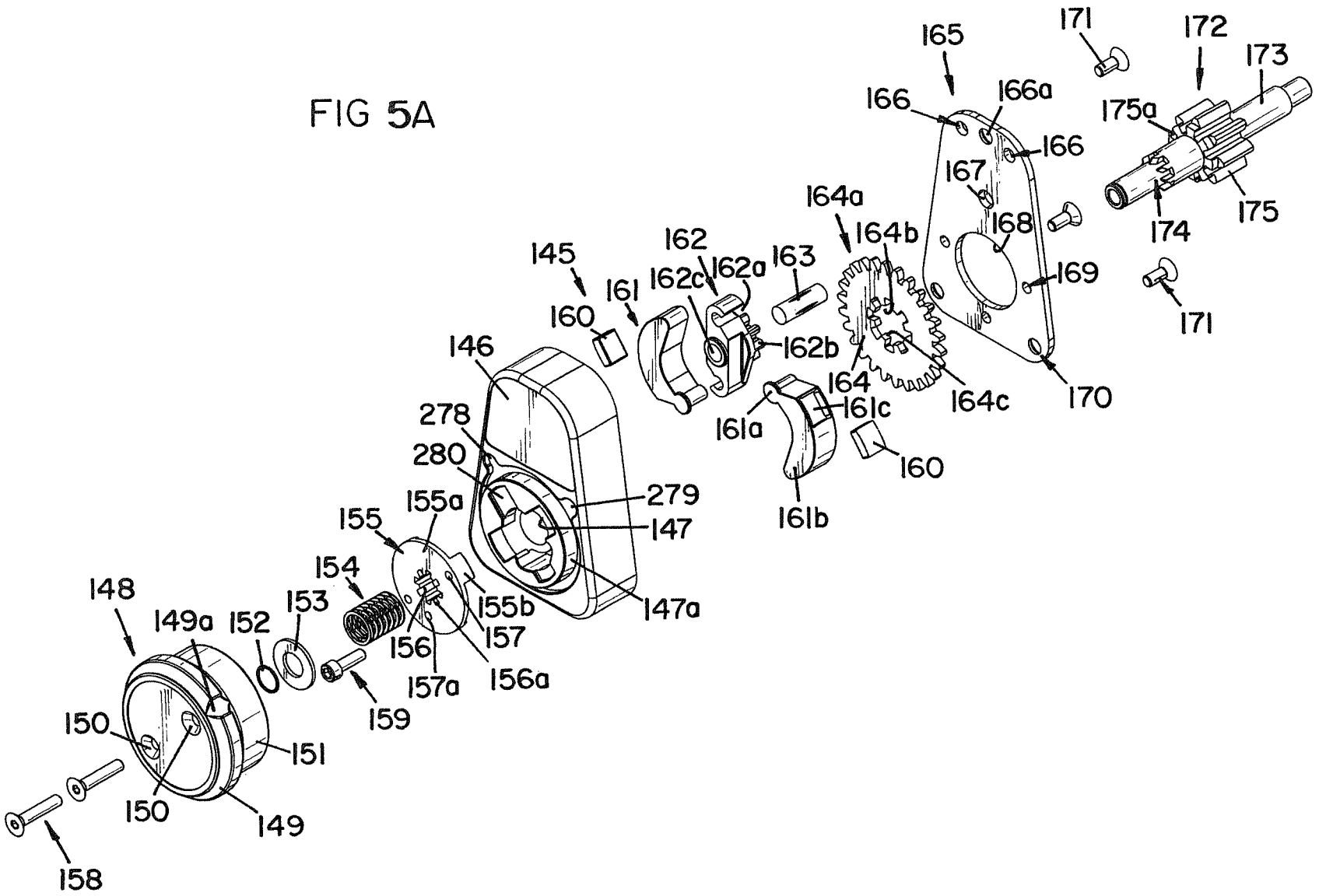
FIG. 5A is an exploded front perspective view of a control and descending assembly of the safety device shown in FIG. 1.
Figure 5B:
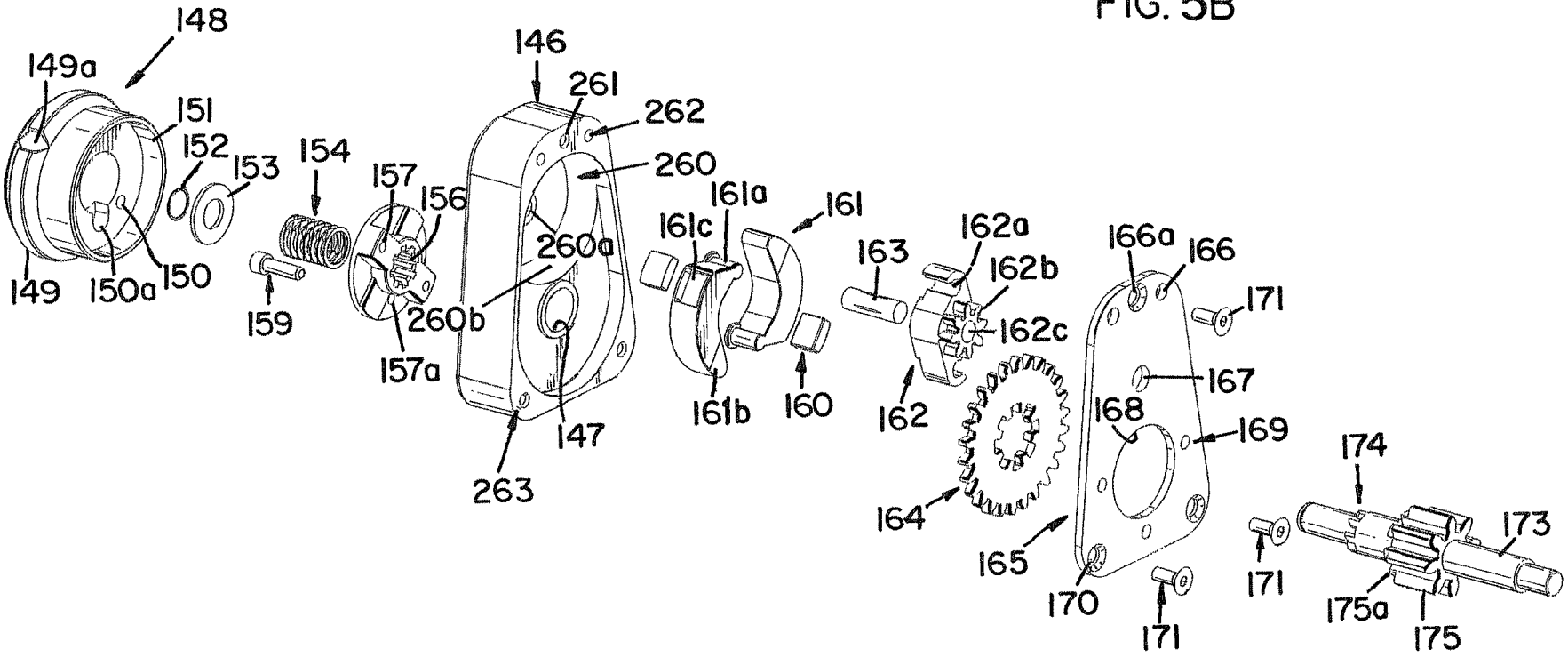
FIG. 5B is an exploded rear perspective view of the control and descending assembly shown in FIG. 5A.

A control and descending assembly 145 is operatively connected to the front plate 102 proximate the bottom opening 105. The assembly 145, which is shown in FIGS. 5A and 5B, includes a housing 146, which houses some of the other assembly components, and a control knob 148 operatively connected to the housing 146. Proximate the bottom of the front side, the housing 146 includes a bore 147 with a flanged portion 147*a* extending outward proximate the perimeter of the bore 147. Proximate the flanged portion 147*a*, the bore 147 includes notches 280, preferably spaced approximately ninety degrees apart. In the orientation shown in FIG. 5A, the top right notch 280 is deeper than the top left notch 280, which allows the spline sleeve 155 to have an inward and an outward position or engagement relative to the housing 146. The spline sleeve 155 is in the inward position when the position indicator 149*a* is positioned proximate the top right notch 280, and the spline sleeve 155 is in the outward position when the position indicator 149*a* is positioned proximate the top left notch 280. When the spline sleeve 155 is in the inward position, it is engaged with the pinion gear 172 and locked. When the spline sleeve 155 is in the outward position, it is disengaged from the pinion gear 172 and unlocked. Relative to the front of the assembly 145, between the bottom left and right notches 280 is a recessed portion 281, which extends further into the housing 146. Proximate the top two notches 280 on opposing sides of the flanged portion 147*a* are slots 278 and 279.

As shown in FIG. 5B, the rear side of the housing 146 includes a cavity 260 with sides 260*b*. Within the cavity 260, the side proximate the front of the housing 146 includes a receiver 260*a*. Above the cavity 260 is a bore 261 with an aperture 262 on each side. The bore 147 extends through the housing 146 between the cavity 260 and the bottom of the housing 146. The bottom of the housing 146 includes a bore 263 on each side of the bottom.

The knob 148 includes a flange portion 149, which preferably has a knurled outer surface and a position indicator 149*a*, and a cylindrical portion 151 extending outward from the flange portion 149. Bores 150 extend axially through the knob 148. The cylindrical portion 151 is configured and arranged to house some of the components of the assembly 145. A spline sleeve 155 is generally washer-shaped with tabs 155*b* extending outward from the base portion 155*a*. The tabs 155*b* are configured and arranged to correspond with the notches 280 in the housing 146. A bore 156 extends through the center of the base portion 155*a*, and apertures 157 and 157*a* are positioned around the bore 156. Apertures 157 are on opposing sides of the bore 156, and aperture 157*a* is on a side of the bore 156 between apertures 157. The surface of the base portion 155*a* forming the bore 156 includes teeth 156*a*. A spring 154 is positioned proximate the bore 156, and a washer 153 and a spiral ring 152 are positioned between the spring 154 and the front plate portion of the knob 148. The spring 154 exerts a biasing force against the spline sleeve 155, which moves inwardly and outwardly relative to the housing 146.

Fasteners 158 extend through bores 150 of the knob 148 and into the two opposing apertures 157 of the spline sleeve 155 to connect the knob 148 and the spline sleeve. Fastener 159 extends through the aperture 157*a* between the opposing apertures 157 and is configured and arranged to be received in the recessed portion 281 when the control and descending assembly 145 is in select positions relative to the housing 146.

Figure 16:
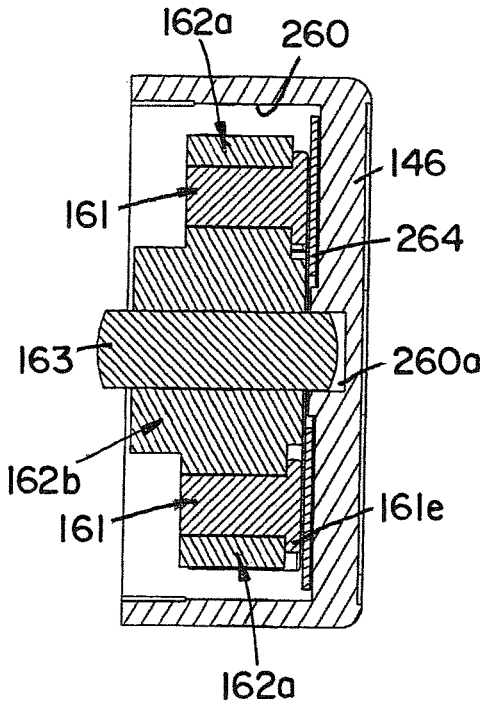
FIG. 16 is a cross-section view of the first brake assembly taken proximate the rotation axis of the assembly shown in FIG. 15.
Figure 15:
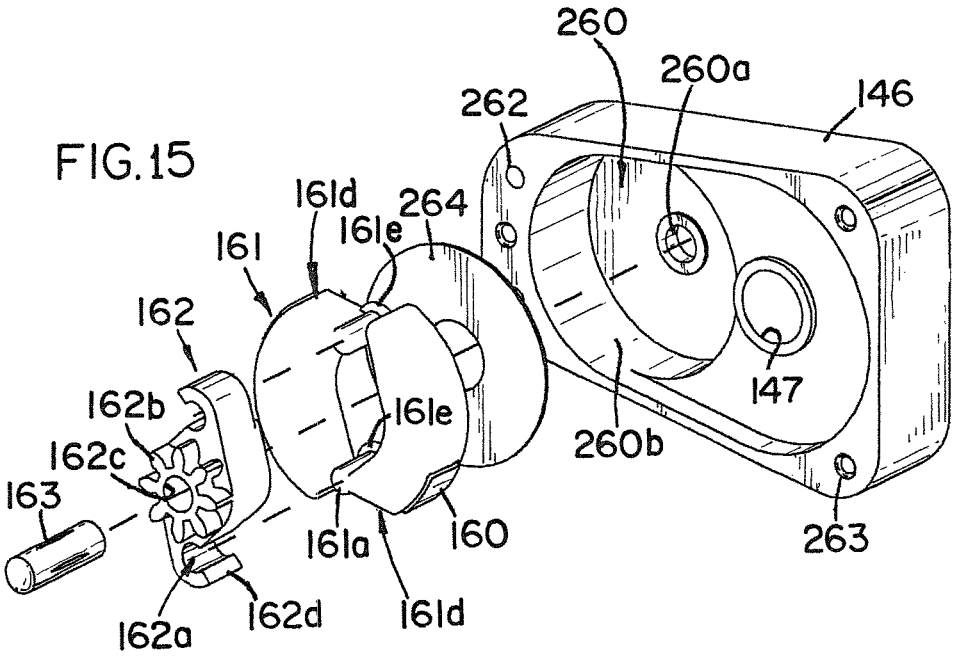
FIG. 15 is an exploded perspective view of a first brake assembly of the control and descending assembly shown in FIGS. 5A and 5B.
Figure 17:
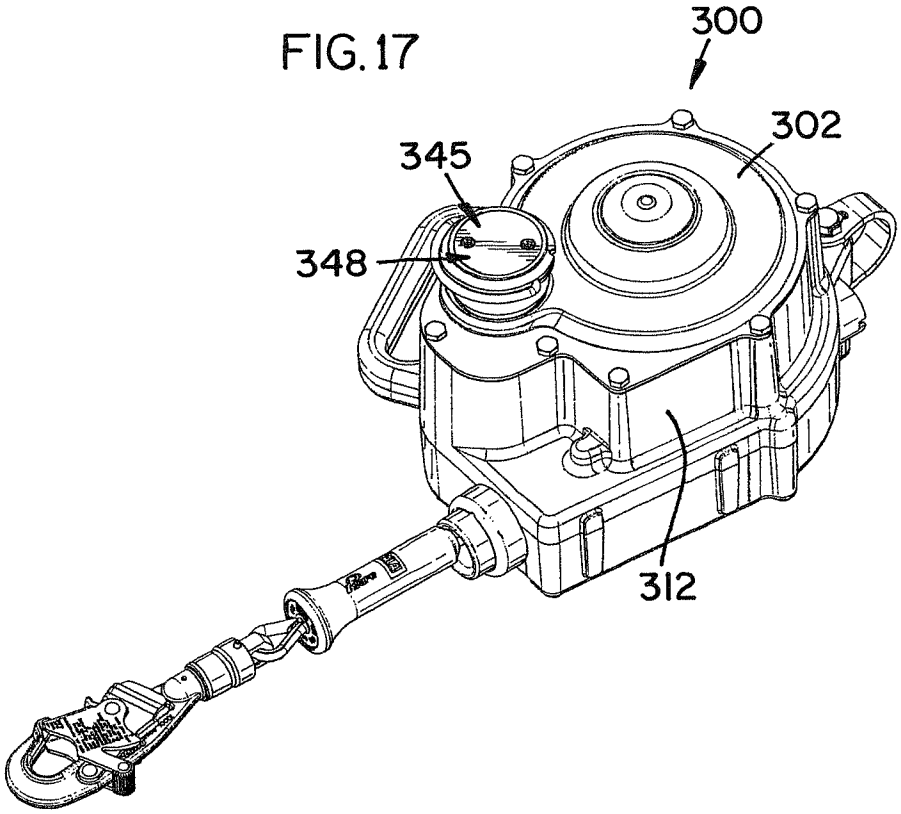
FIG. 17 is a front perspective view of another embodiment safety device with fall arrest and descending modes constructed according to the principles of the present invention.
Figure 18:
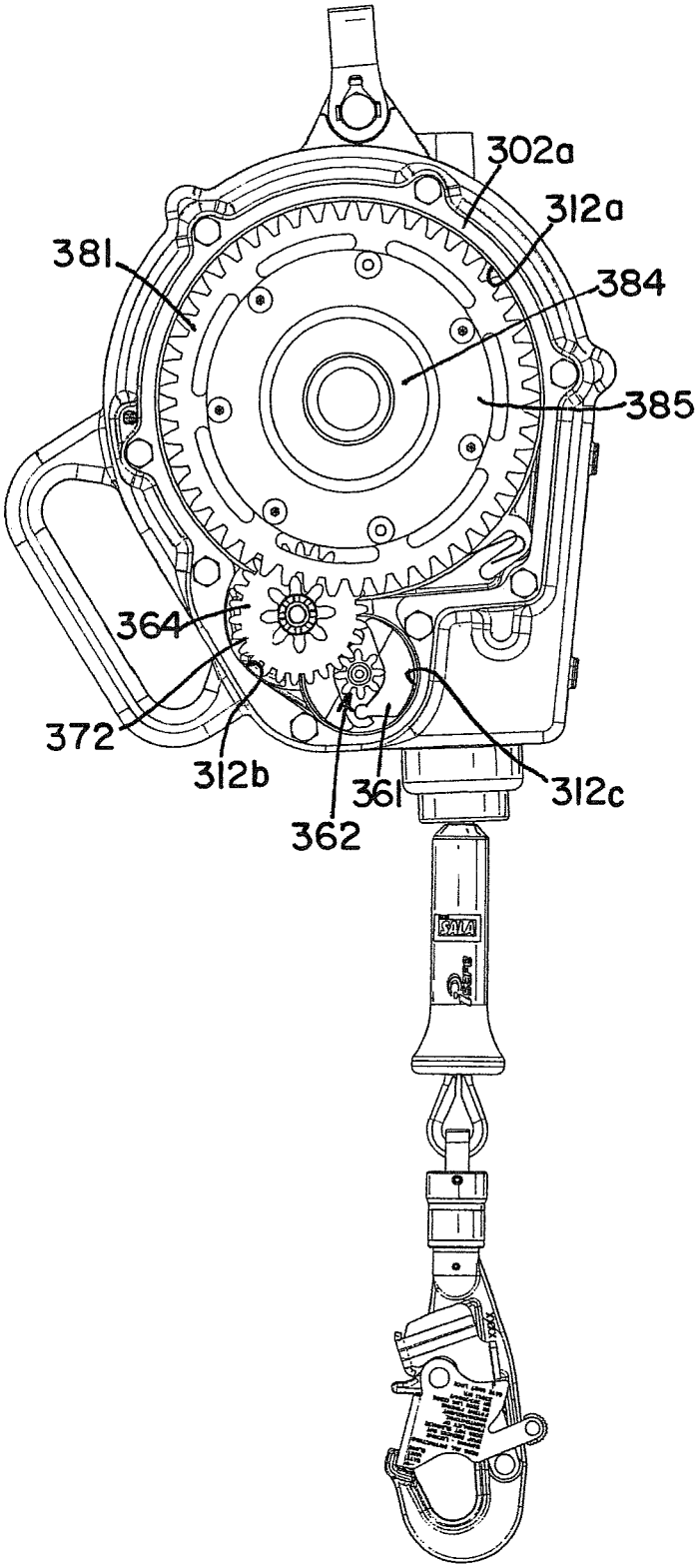
FIG. 18 is a front view of the safety device shown in FIG. 17 with a front plate removed.
Figure 19:
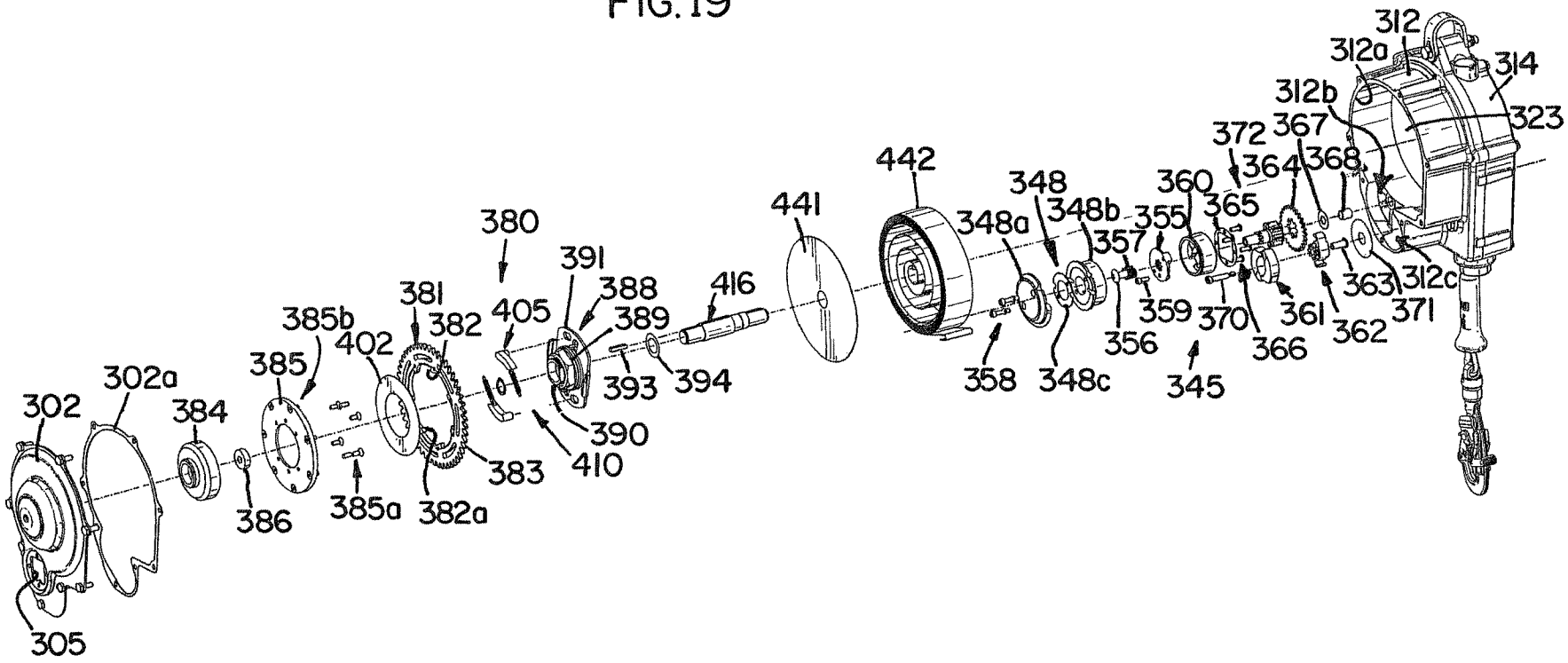
FIG. 19 is a partial exploded perspective view of the safety device shown in FIG. 17.
Figure 20:
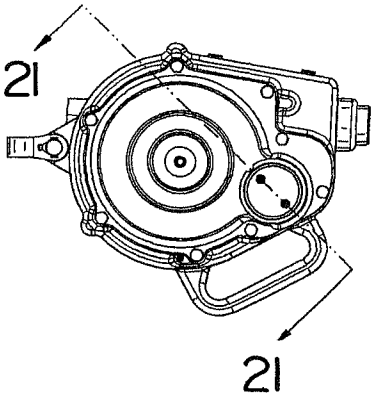
FIG. 20 is a front view of the safety device shown in FIG. 17.
Figure 21:
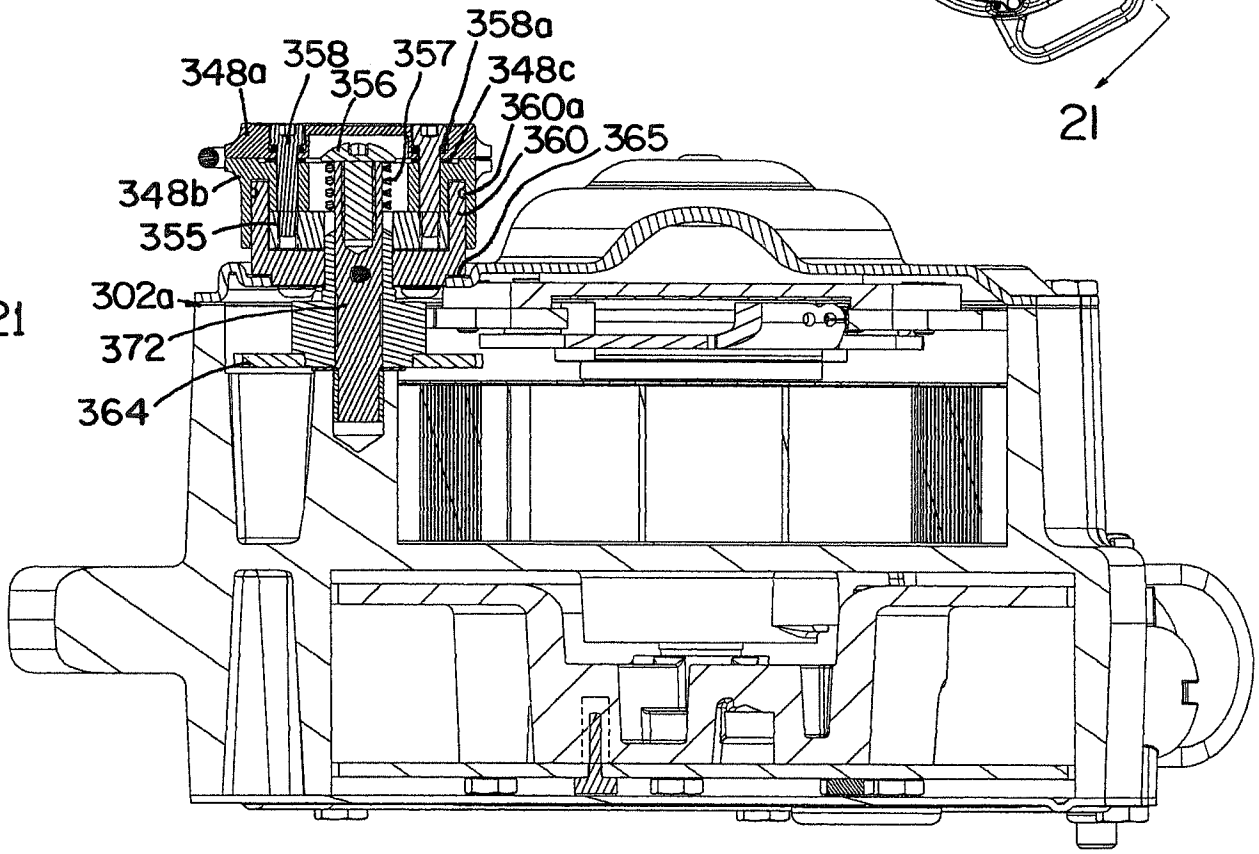
FIG. 21 is a cross-sectional view taken along the lines 21-21 in FIG. 20.
Figure 22:
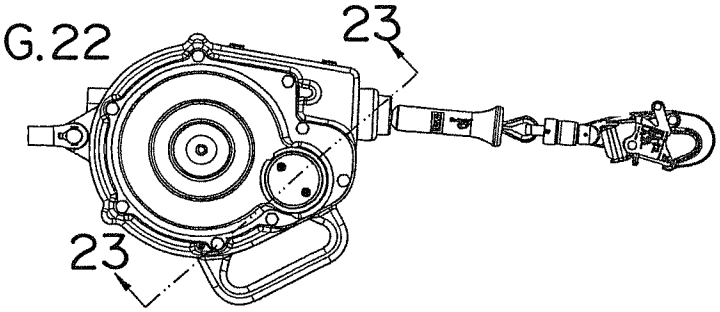
FIG. 22 is a front view of the safety device shown in FIG. 17.
Figure 23:
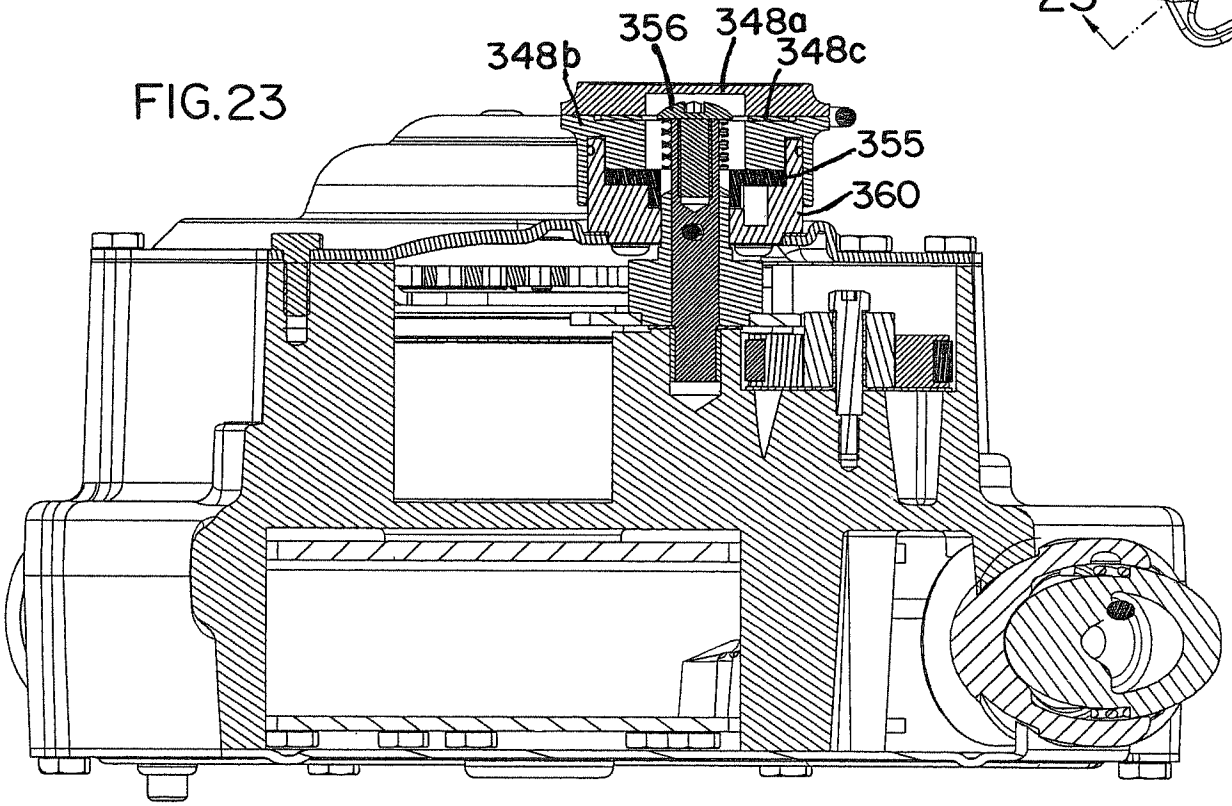
FIG. 23 is a cross-sectional view taken along the lines 23-23 in FIG. 22.
Figure 24:
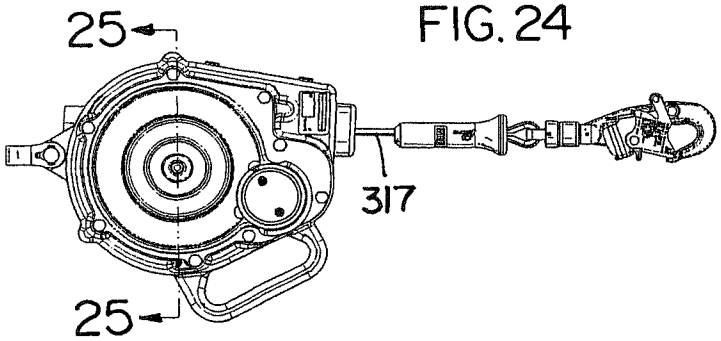
FIG. 24 is a front view of the safety device shown in FIG. 17.
Figure 25:
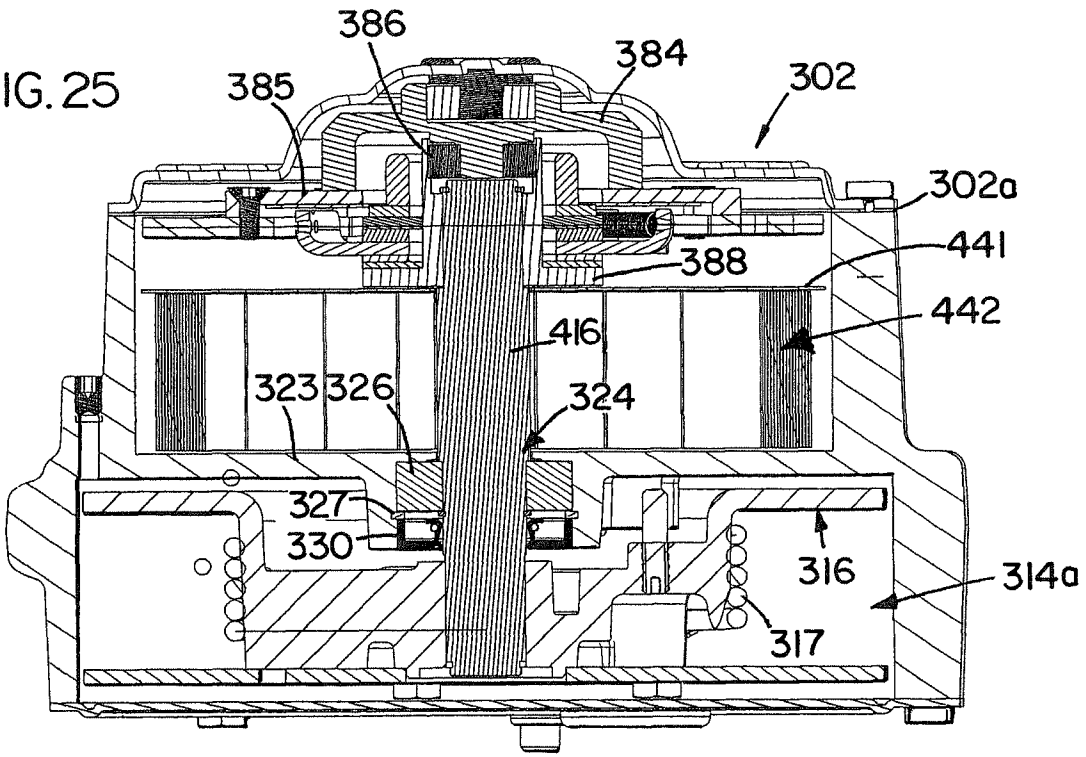
FIG. 25 is a cross-sectional view taken along the lines 25-25 in FIG. 24.

Positioned above the knob 148, on the opposing side of the housing 146, is a first brake assembly. The first brake assembly includes a rotor 162, pawls 161, and friction pads 160, which fit within the cavity 260. The rotor 162 includes a base from which pivot receivers 162*a* extend on opposing sides of the base and to which a gear 162*b* is operatively connected. The ends of the pivot receivers 162*a* include relatively flat surfaces 162*d*. A bore 162*c* extends through the base and the gear 162*b*. Each of the pawls 161 includes a pivot portion 161*a*, which is configured and arranged to fit and pivot within the respective pivot receiver 162*a*. Each pivot portion 161*a* includes a flanged portion 161*e* proximate one side of the pivot portion 161*a*. Each of the pawls 161 also includes a free end 161*b* and a pad receiver 161*c*. The pad receiver 161*c* is positioned on the outer surface of the pawl 161 between the pivot portion 161*a* and the free end 161*b*. The pad receiver 161*c* is configured and arranged to receive a portion of a friction pad 160. Each of the pawls 161 also includes a relatively flat surface 161*d* proximate between the pivot portion 161*a* and the pad receiver 161*c*. An optional disk 264, preferably made of a plastic having a low coefficient of friction, could be positioned between the pawls 161 and the housing 146 to reduce the friction of the flanged portions 161*e* on the housing 146. The disk 264 is shown in FIGS. 15 and 16 but is not shown in FIGS. 5A and 5B. A groove pin 163 extends through the bore 162*c*, and one end of the groove pin 163 fits within the receiver 260*a* and the other end fits within the middle aperture 167.

A spur gear 164 includes teeth 164*a* around its outer perimeter, an aperture 164*b*, and teeth 164*c* around the perimeter forming the aperture 164*b*. A base plate 165 has a shape corresponding to the shape of the housing 146 and includes top apertures 166 and 166*a*, a middle aperture 167, a bore 168 with apertures 169 around the sides and bottom of the bore 168, and bottom apertures 170. Fasteners 171 extend through apertures 166*a* and 170 into bores 261 and 263 to connect the base plate 165 to the housing 146.

A pinion gear 172 includes a shaft portion 173 to which first teeth 174 and second teeth 175 are operatively connected. The first teeth 174 are proximate one end and the second teeth 175 are proximate the middle of the shaft portion 173. The second teeth 175 include a male portion 175*a*, which extends outward with a smaller diameter from the second teeth 175. The male portion 175*a* is configured and arranged to mate with the teeth 164*c* of the spur gear 164. The ends of the shaft portion 173 preferably have a smaller diameter than the middle of the shaft portion 173.

When the assembly 145 is assembled, the pinion gear 172 extends through the bore 168 of the base plate 165, the aperture 164*b* of the spur gear 164, the bore 147 of the housing 146, the bore 156 of the spline sleeve 155, the bore of the spring 154, the aperture of the washer 153, and the aperture of the spiral ring 152. Because the knob 148 is connected to the spline sleeve 155, the knob 148 is connected to the pinion gear 172 via the spline sleeve 155. Because the spring 154 is fixedly connected to the end of the shaft portion 173 proximate the first teeth 174, the spring 154 exerts a biasing force against the spline sleeve 155 toward the housing 146. The first teeth 174 mate with the teeth 156*a* of the spline sleeve 155, and the male portion 175*a* of the second teeth 175 mate with the teeth 164*c* of the spur gear 164. The teeth 164*a* of the spur gear 164 mate with the teeth of the gear 162*b*.

As shown in FIGS. 15 and 16, the pivot receivers 162*a* receive the respective pivot portions 161*a* of the pawls 161, and the flanged portions 161*e* are positioned proximate one side of the rotor 162 between the rotor 162 and the housing 146. The flanged portions 161*e* prevent the pivot portions 161*a* from sliding out of the pivot receivers 162 from the opposite side of the rotor 162. Although this rotor and pawl arrangement is shown with respect to the first brake assembly, it is recognized that this arrangement could be used with other types of brake assemblies.

Figure 6:
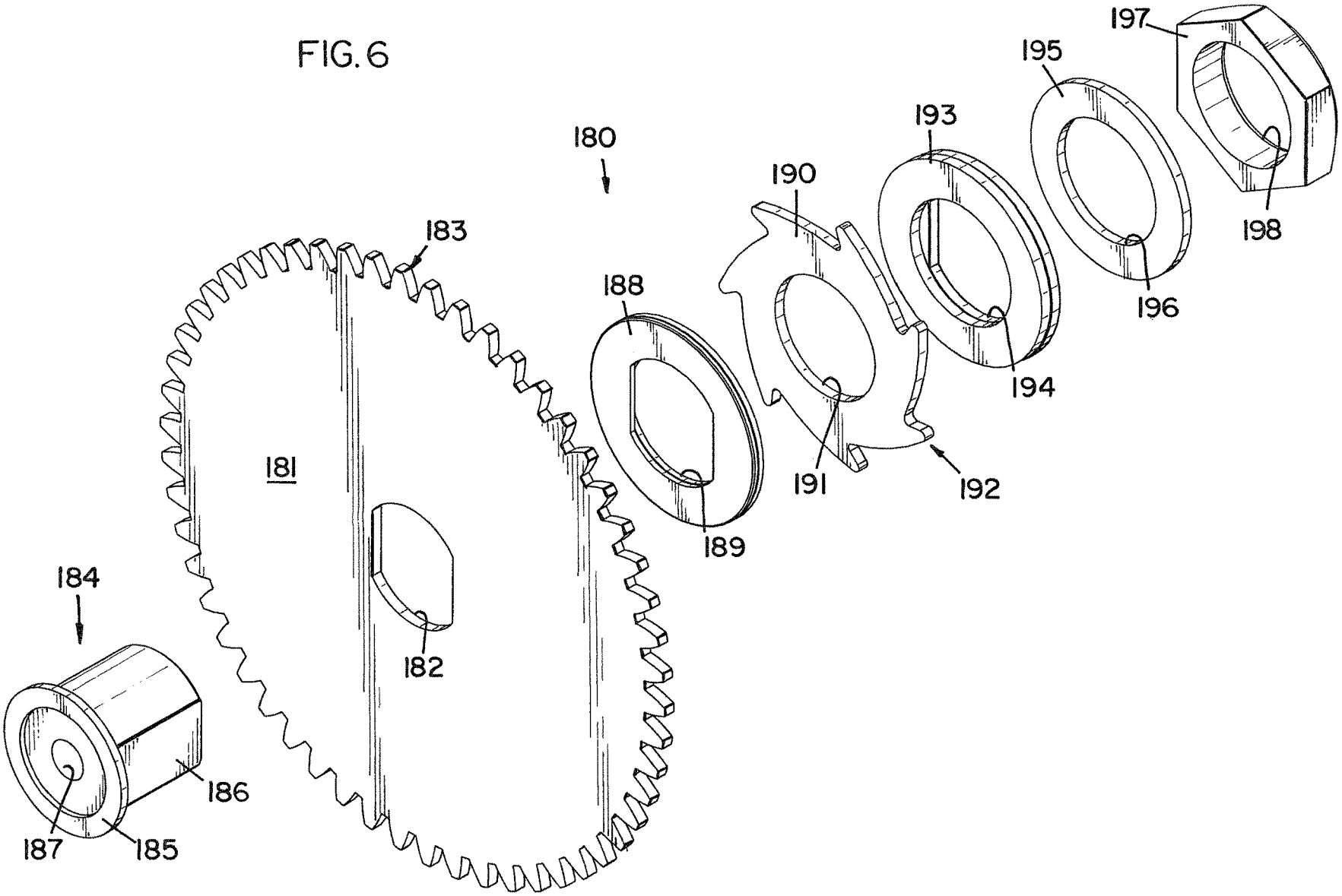
FIG. 6 is an exploded perspective view of a portion of a brake assembly of the safety device shown in FIG. 1.

Proximate the other, inner side of the front housing portion 101 is a gear assembly 180, which is operatively connected to the second teeth 175, which extends through the bottom opening 105 of the front housing portion 101. The gear assembly 180, shown in FIG. 6, includes a hub 184, a spur gear 181, a friction disk 188, a ratchet disk 190, a friction disk 193, a spring disk 195, and a lock nut 197. The hub 184 includes a flange portion 185 and a cylindrical portion 186 extending outward from the flange portion 185. A bore 187 extends longitudinally through the hub 184. The spur gear 181 includes an aperture 182 and teeth 183. The friction disk 188 includes an aperture 189. The ratchet disk 190 includes an aperture 191 and teeth 192. The friction disk 193 includes an aperture 194. The spring disk 195 includes an aperture 196. The lock nut 197 includes an aperture 198. The cylindrical portion 186 extends through the aperture 182 of the spur gear 181, the aperture 189 of the friction disk 188, the aperture 191 of the ratchet disk 190, the aperture 194 of the friction disk 193, the aperture 196 of the spring disk 195. The cylindrical portion 186 has opposing sides that are flat, and the surfaces forming apertures 182, 189, and 194 have corresponding flat portions so that the spur gear 181, the friction disk 188, and the friction disk 193 do not rotate about the cylindrical portion 186. The aperture 198 of the lock nut 197 receives the end of the cylindrical portion 186, and the flange portion 185 of the hub 184 and the lock nut 197 secure the other components to the cylindrical portion 186. The teeth 183 of the spur gear 181 mate with the second teeth 175 of the pinion gear 172.

An isolation disk 202 with an aperture 203 is positioned proximate the gear assembly 180, and a drum 220 is positioned proximate the isolation disk 202. The drum 220 includes a cylindrical hub portion 221 with an end portion 221*a* covering one end and a flange 224 proximate the opposing end extending outward from the hub portion 221. The end portion 221*a* includes cylindrical portions 222 with apertures and a bore 223 proximate the middle of the end portion 221*a*.

The hub portion 221 forms a cavity in which a portion of the second brake assembly is housed. The second brake assembly includes the gear assembly 180 and pawls 205. Each pawl 205 includes a rocker portion 206, an engaging portion 207, and an extension portion 208. The extension portion 208 extends outward from the respective pawl 205 and fits within the bore formed by the respective cylindrical portion 222 in the end portion 221*a*. Springs 210 bias the pawls 205 in a disengaged position. Each spring 210 includes a first end 211, a second end 212, and a coiled portion 213 between the ends 221 and 212. The first end 211 is operatively connected to the end portion 221*a* and the second end 212 is operatively connected to the respective pawl 205. A shaft 216 extends through the bore 223, and bearings 215 are positioned in the bores of the cylindrical portions 222 and the bore 223. The bearing 235 is positioned proximate the bore 223, and the shaft 216 also extends through the bearing 235.

A cable 225 includes a first end 226 operatively connected to the drum 220 and a second end 227 operatively connected to a hook 230. Proximate the hook 230 is a stop 228, which fits within the cavity 117 proximate the opening 116, and a bumper 229, which protects the second end 227 of the cable 225 and prevents the cable 225 from being completely retracted into the housing. The shear pin 232 creates a reserve portion of the cable 225, and the spacer 233 positions the cable 225 with the shear pin 232 to maintain a consistent breakage point.

A flange 238 is operatively connected to the end portion 221*a* with fasteners 239 extending through apertures 238*a*. An intermediate portion of the cable 225 is wound at least partially around the outside of the hub 221, and the flanges 224 and 238 keep the cable 225 from sliding off the hub 221. An isolation disk 241 is positioned proximate the flange 238, and a spring 242, which is preferably a motor spring, is positioned between the isolation disk 241 and the rear plate 122. One end of the spring 242 is connected to the rear housing portion 121, and the other end of the spring 242 is connected to the shaft 216 via a slot (not shown) receiving the end. The spring 242 exerts a biasing force on the shaft 216.

A front load strap 245 is positioned between the front plate 102 and the control and descending assembly 145. The front load strap 245 includes top apertures 246, an aperture 247 below the top apertures 246, an aperture 248 proximate the middle, apertures 249 below the aperture 248, a bore 250 below the apertures 249, apertures 251 positioned proximate the sides and the bottom of the bore 250, and bottom apertures 252. The fasteners 253 extend through the apertures 246 to connect to the spacers 236, and the fasteners 254 extend through the apertures 252 to connect to the respective coupling hex nuts 234. Alignment pins 177 extend into apertures 249 and extend through top apertures 166 into apertures 262.

A rear load strap 265 is positioned proximate the rear plate 122. The rear load strap 265 includes top apertures 266, an aperture 267 below the top apertures 266, an aperture 268 proximate the middle, apertures 271 below the aperture 268, and bottom apertures 272. The fasteners 273 extend through the apertures 266 to connect to the spacers 236, and the fasteners 274 extend through the apertures 272 to connect to the respective coupling hex nuts 234.

The coupling hex nuts 234*a* and 234*b* and the spacers 236 assist in interconnecting the front and rear housing portions 101 and 121. The tops of the housing portions include bores (only bores 110*a* in top 108 are shown) configured and arranged to receive the spacers 236, which include threaded bores configured and arranged to receive fasteners 253 and 273. Fasteners 253 extend through apertures 246 in the front load strap 245 and into the threaded bores of the spacers 236. Fasteners 273 extend through apertures 266 in the rear load strap 265 and into the threaded bores of the spacers 236. Proximate the sides of the housing portions 101 and 121, the housing portions 101 and 121 form bores 141 configured and arranged to receive the coupling hex nuts 234*a*, which include threaded bores configured and arranged to receive the fasteners 254*a* and 274*a*. The bottoms of the housing portions include bores corresponding with apertures (only apertures 107 are shown) configured and arranged to receive the coupling hex nuts 234*b*, which include threaded bores configured and arranged to receive fasteners 254*b* and 274*b*. Fasteners 254*b* extend through apertures 252 in the front load strap 245 and into the threaded bores of the coupling hex nuts 234*b*. Fasteners 274*b* extend through apertures 272 in the rear load strap 265 and into the threaded bores of the coupling hex nuts 234*b*. A sponge cord 237 helps seal the front and rear housing portions 101 and 121.

When the safety device 100 is assembled, the shaft 216 extends from proximate the front housing portion 101 to the rear housing portion 121. Fastener 258 extends through the aperture 248 in the front load strap 245, through the center aperture 104 in the front plate 102, and into the bore in the shaft 216. Fastener 259 extends through the aperture 268 in the rear load strap 265, through the center aperture 124 in the rear plate 122, and into the bore in the shaft 216. The shaft 216 extends through bore 187 of the gear assembly 180 and the aperture 203 of the isolation disk 202 between the front housing portion 101 and the drum 220, the shaft 216 extends through the bore 223 of the drum and the bearings 215 and 235, and the shaft 216 extends through the aperture 241*a* of the isolation disk 241 and is operatively connected to an end of the spring 242 between the drum 220 and the rear housing portion 121. The end of the spring 242 is inserted into a slot (not shown) proximate the end of the shaft 216 thus placing a biasing force on the shaft 216. The shaft 216 rotates as cable 225 is paid out from around the drum 220 and winds the spring 242 more tightly. Because the spring 242 wants to unwind, the spring 242 places a biasing force on the shaft 216 to automatically retract and wind the cable 225 around the drum 220. If the cable 225 is paid out too quickly from the drum 220, for example should a fall occur, the pawls 205 pivot outwardly and engage the teeth 192 on the ratchet disk 190, which stops the drum 220 from rotating when positioned in a fall arrest mode.

Figure 4:
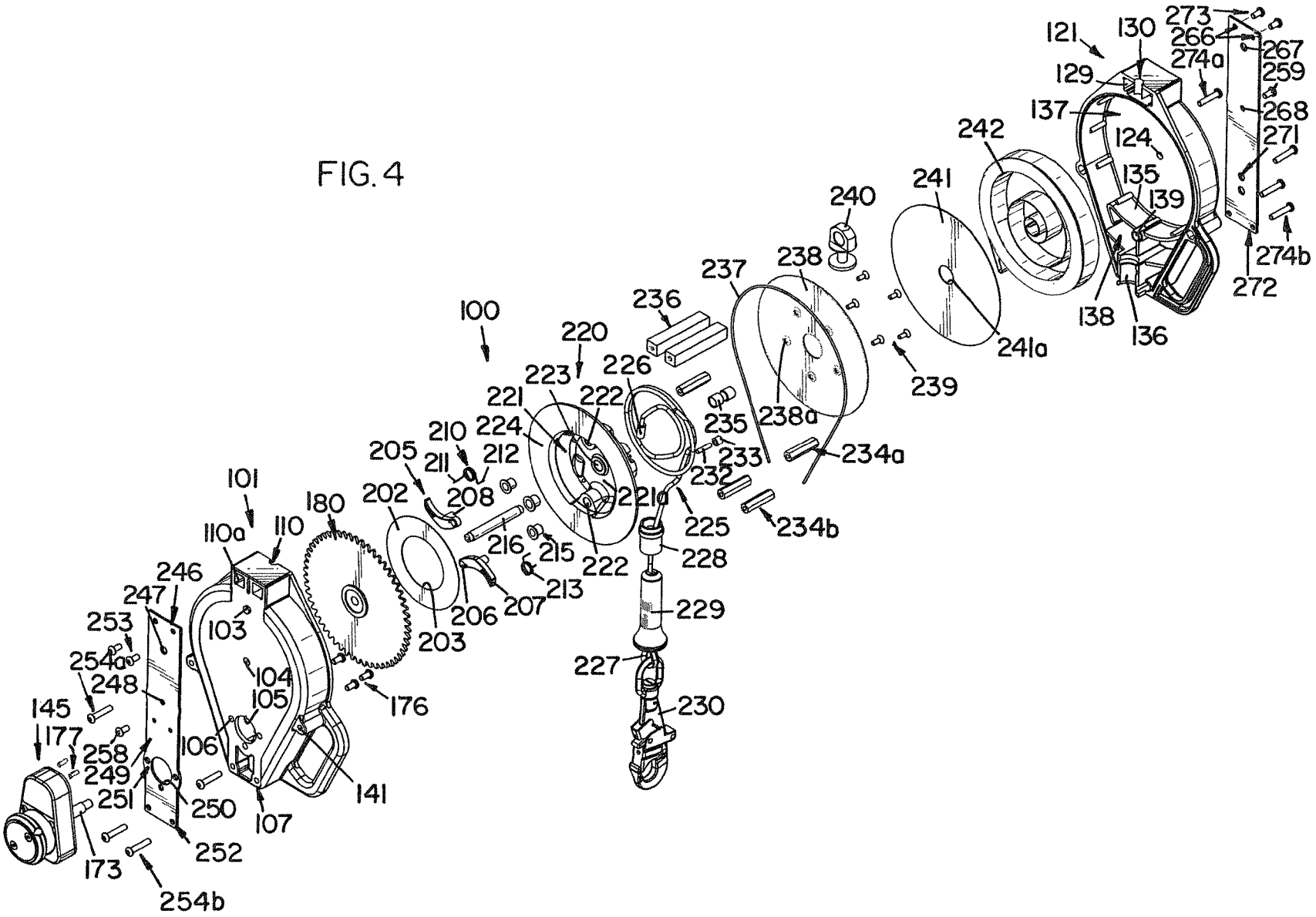
FIG. 4 is an exploded perspective view of the safety device shown in FIG. 1.

As shown in FIG. 4, the fasteners 176 extend through the apertures 106 of the front plate 102, through the apertures 251 of the front load strap 245, and into bores 169 in the base plate 165 to connect the control and descending assembly 145 to the front housing portion 101. The shaft portion 173 and a portion of the second teeth 175 of the pinion gear 172 extend through the bore 250 of the front load strap 245 and through the bottom opening 105 of the front plate 102 so that the male portion 175*a* of the second teeth 175 mate with the teeth 164*c* of the spur gear 164 and the second teeth 175 mate with the teeth 183 of the gear assembly 180. The shaft portion 173 extends further outward into the bore 139 in the rear housing portion 121.

Figure 12:
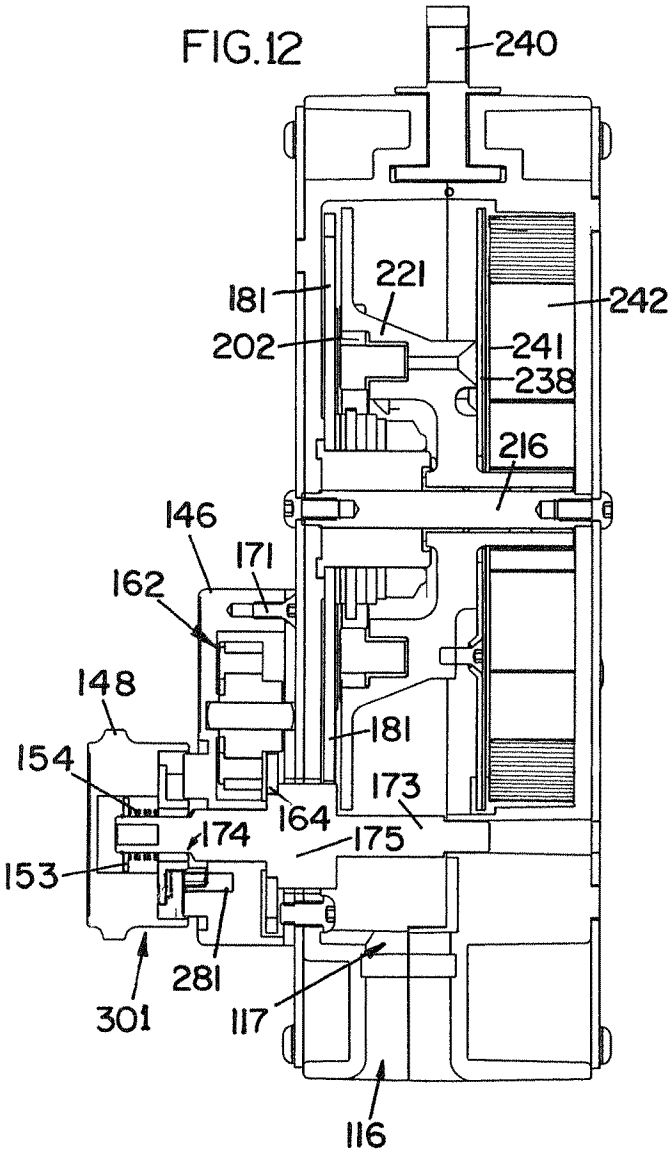
FIG. 12 is a cross-section view of the safety device taken along the lines 12-12 in FIG. 11.
Figure 11:
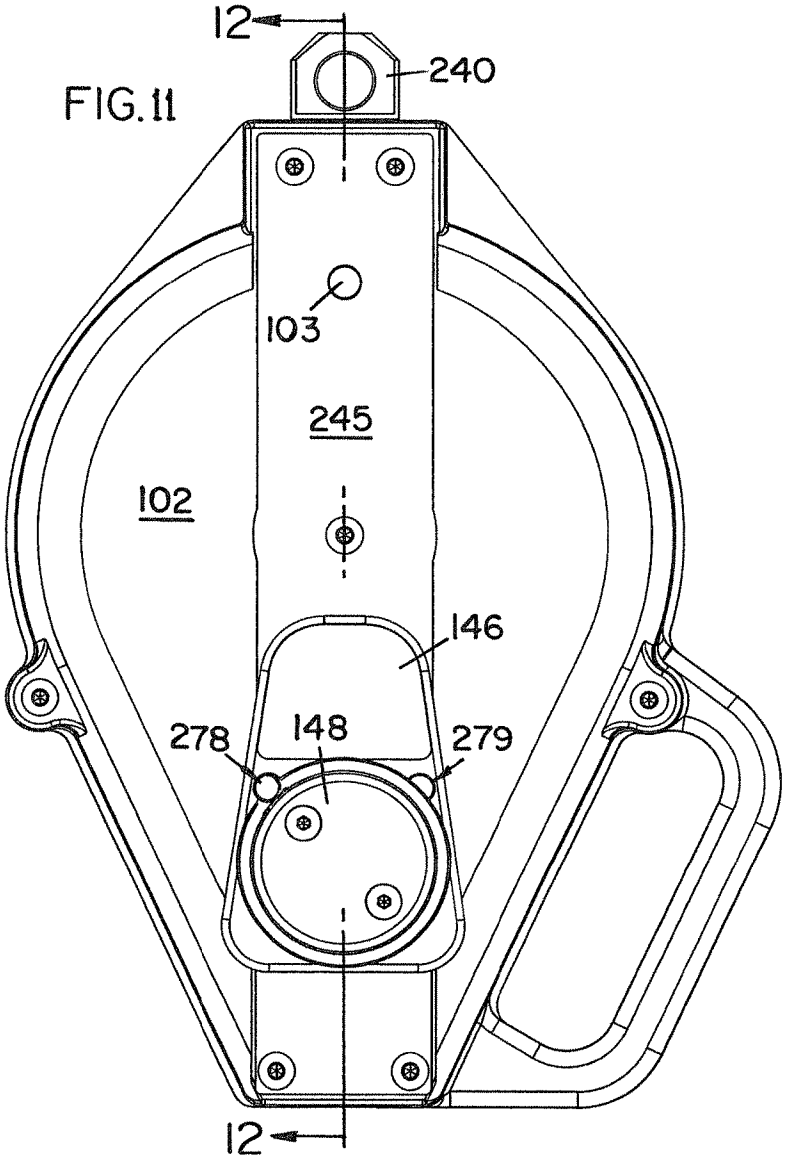
FIG. 11 is a front view of the safety device shown in FIG. 1 in a descending mode.
Figure 13:
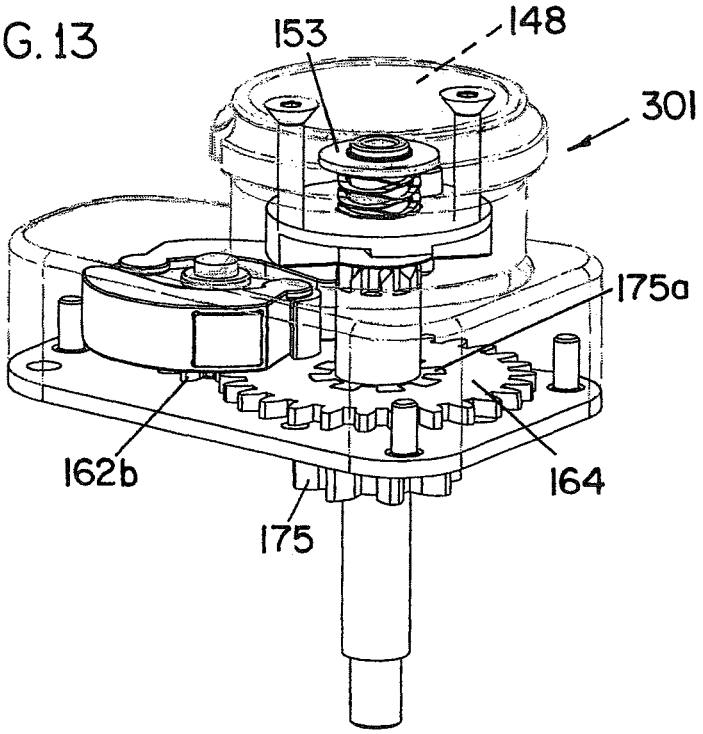
FIG. 13 is a perspective view of the control and the descending assembly in the descending mode.
Figure 14:
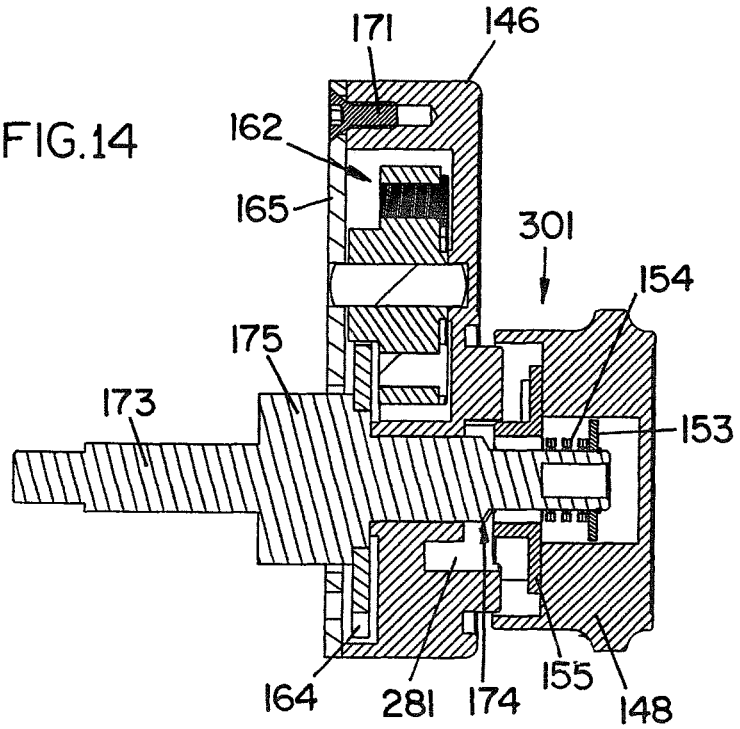
FIG. 14 is a cross-section view of the control and the descending assembly in the descending mode.

When the knob 148 of the control and descending assembly 145 is positioned in the first position 278, the device 100 is positioned in a descending mode, as shown in FIG. 11. In the descending mode, the pinion gear 172 is allowed to rotate because the knob 148 is not locked relative to the housing 146. As shown in FIGS. 12-14, the spline sleeve tabs 155*b* are not engaged by the housing 146 and the knob 148 is in a disengaged position 301, the knob 148 positioned outward relative to the housing 146. Thus, because the pinion gear 172 can rotate, the gear assembly 180 can rotate, and the second brake assembly cannot operate properly. This allows the first brake assembly to operate. When the pinion gear 172 rotates, the spur gear 164 and the rotor 162 rotate, and when the rotor 162 rotates, the pawls 161 pivot outward so that the friction pads 160 contact the sides 260*b* of the housing 146. The friction between the friction pads 160 and the housing 146 slows the rate of rotation of the pinion gear 172, which slows the rate of rotation of the drum 220, which slows the rate the cable 225 is paid out to control the rate of descent of the user connected to the hook 230. The first brake assembly does not include springs so the pawls 161 could pivot outward during use of the device 100. Thus, it is possible the friction pads 160 could contact the sides 260*b* of the housing 146, but until the pinion gear 172 is rotating rapidly, relatively little to no braking force would occur. As the rotational rate increases, the braking force increases. It is recognized that the first brake assembly could also include springs to bias the pawls inward relative to the rotor 162.

The pawls 161 include surfaces 161*d*, which contact the surfaces 162*d* of the rotor 162 when the pawls 161 pivot outward relative to the rotor 162. However, the friction pads 160 contact the sides 260*b* of the housing 146 prior to the surfaces 161*d* and 162*d* contacting each other thus limiting the outward movement of the pawls 161.

Figure 8:
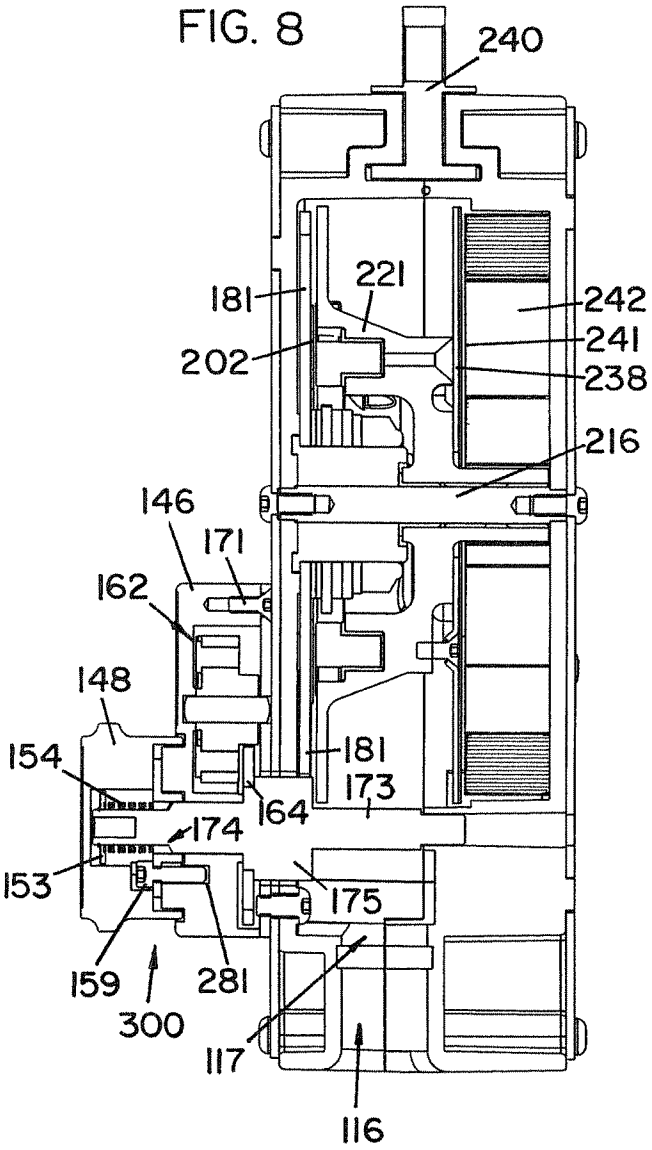
FIG. 8 is a cross-section view of the safety device taken along the lines 8-8 in FIG. 7.
Figure 7:
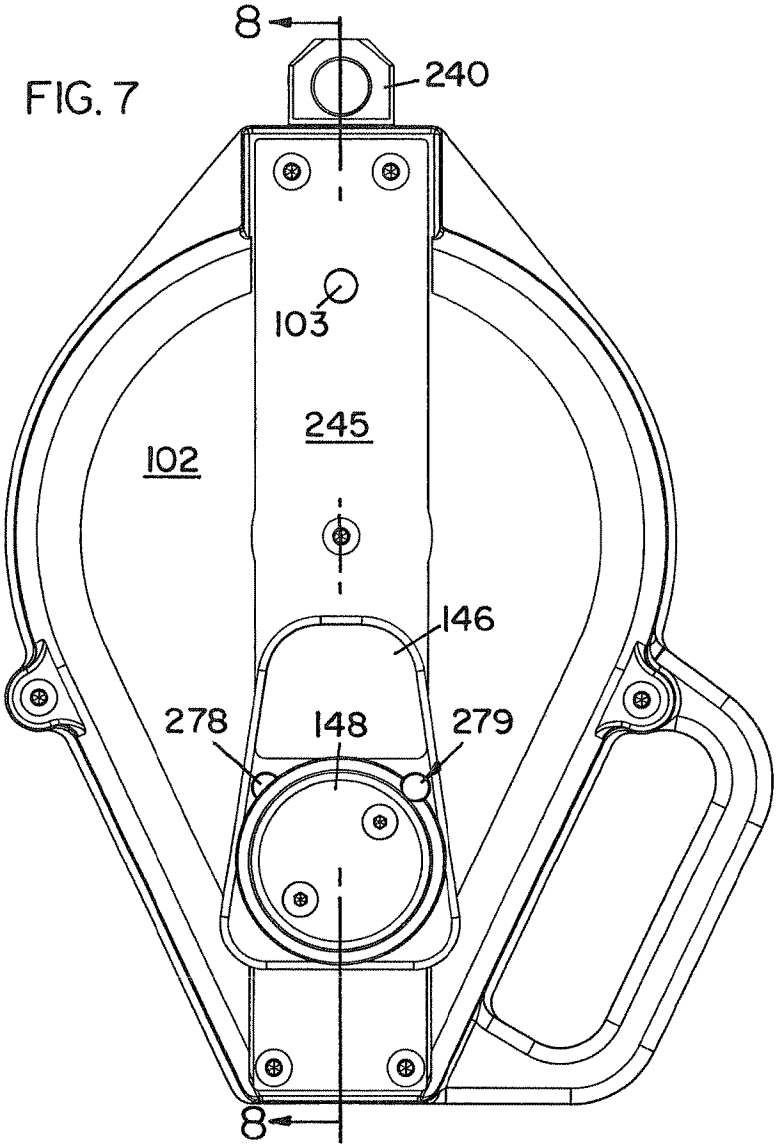
FIG. 7 is a front view of the safety device shown in FIG. 1 in a fall arrest mode.

When the knob 148 is positioned in the second position 279, the device 100 is positioned in a fall arrest mode, as shown in FIG. 7. In the fall arrest mode, the pinion gear 172 does not rotate because the knob 148 is locked relative to the housing 146. As shown in FIGS. 8-10, the spline sleeve tabs 155*b* are engaged by the housing 146 and the knob 148 is in an engaged position 300, the knob 148 positioned inward relative to the housing 146. The tabs 155*b* are received in the respective notches 280 and the fastener 159 is received in the recessed portion 281, as shown in FIGS. 8-10. The fastener 159 and the recessed portion 281 prevent the knob 148 from over-rotating past the positions 278 and 278. The spring 154 places a biasing force on the spline sleeve 155, and thus the knob 148, to keep the knob 148 biased in the second position 279. Thus, because the pinion gear 172 cannot rotate, the gear assembly 180 cannot rotate, and the second brake assembly can operate properly. In other words, the ratchet disk 190 is locked in place so that when the drum 220 rotates at a predetermined speed and the pawls 205 pivot to engage the teeth 192 of the ratchet disk 190, rotation of the drum 220 stops because the gear assembly 180 does not rotate.

In operation, the safety device 100 is operatively connected to a support structure, and the cable is operatively connected to a safety harness donned by a worker. The worker is free to move about the vicinity of the safety device 100, with only the length of the cable restricting the distance of the worker's movement. As the worker moves further away from the safety device 100, cable is paid out of the device as it is unwound from the drum 220. As the worker moves closer to the safety device 100, cable is retracted into the device as it is wound about the drum 220.

A sudden acceleration or predetermined rate of speed at which the drum 220 turns to pay out cable causes the pawls 205 to overcome the forces of the springs 210. The centrifugal force causes the pawls 205 to pivot away from the central portion of the hub 221. The forces of the springs 210 are overcome, the extension portions 208 rotate within the cylindrical portions 222, and the engaging portions 207 move outward so that at least one of the pawls 205 engages at least one of the ratcheting teeth 192 of the gear assembly 180. When the gear assembly 180 is locked in the fall arrest mode, engagement of the gear assembly 180 by at least one of the pawls 205 activates the rest of the second brake assembly. Because the pawls 205 engage the ratcheting teeth 192 and can no longer rotate, the pawls 205 cause the brake hub 184 to rotate. The brake hub 184, which is rotatably mounted to shaft 216 but does not normally rotate about shaft 216, begins to rotate with the pawls 205 and the drum 220. The torque is set to a predetermined level to slow and eventually stop rotation of the brake hub 184. Once at least one of the pawls 205 has engaged at least one of the ratcheting teeth 192, they cannot be disengaged until the drum 220 begins to rotate backward to rewind the cable onto the drum hub 221. If the gear assembly 180 is allowed to rotate in the descending mode, engagement of the gear assembly 180 by at least one of the pawls 205 does not activate the rest of the second brake assembly, and the first brake assembly is activated.

In the descending mode, although the gear assembly 180 is engaged by at least one of the pawls 205, the second brake assembly cannot operate properly because the gear assembly 180 rotates with the pinion gear 172. The rotating pinion gear 172 rotates the spur gear 164, which rotates the gear 162*b* of the rotor 162, which rotates the rotor 162 and the pawls 161. The pivot portions 161*a* of the pawls 161 will pivot within the pivot receivers 162*a* and the free ends 161*b* will move outward relative to the rotor 162 to contact the surface of the housing 146. The friction between the friction pads 160 and the housing 146 slows the rate of rotation of the pinion gear 172, which slows the rate of rotation of the drum 220, which slows the rate the cable 225 is paid out to control the rate of descent of the user connected to the hook 230. This type of centrifugal brake (the first brake assembly) will engage to some degree as the rotor rotates, and the braking force will increase as the angular velocity is increases. Although springs are not used, it is recognized that springs could be used to bias the pawls inward and the brake pads could be prevented from contacting the housing and applying any braking force until a predetermined angular velocity is reached.

In another embodiment, the knob can be moved from the second position (fall arrest mode) to the first position (descending mode) after a fall has occurred. A tool (not shown) could be used to assist in moving the knob outward, thus disengaging the fall arrest system and allowing the descending system to function, and the knob can be rotated to the first position. Once the knob is pulled outward (disengaging the spline sleeve from the pinion gear) the descending system will function.

Another embodiment safety device constructed in accordance with the principles of the present invention is designated by the numeral 300 in the drawings. Safety device 300 is similar to the safety device 100 and, therefore, only the substantial differences will be described. The safety device 300 is shown in FIGS. 17-25.

The housing of the safety device 300 is separated into a first portion and a second portion by a plate portion 323. Preferably, the first portion, the second portion, and the plate portion 323 are integral. The plate portion 323 includes a bore 324, which is in fluid communication with a cavity 312*a* of the first portion and a cavity 314*a* of the second portion.

The safety device 300 includes a front plate 302 configured and arranged to cover side 312, which defines cavities 312*a*, 312*b*, and 312*c*. A gasket 302*a* corresponds with the side 312 and is positioned between the front plate 302 and the side 312 to seal the connection thereto. The front plate 302 includes a bottom opening 305 through which a portion of a descent assembly 345 extends and is positioned within the cavity 312*b*. The descent assembly 345 includes a knob 348, which includes a cover 348*a*, a base 348*b*, and a gasket 348*c*. The gasket 348*c* seals the connection between the cover 348*a* and the base 348*b*. Fasteners 358 extend through apertures in the cover 348*a*, the gasket, and the base 348*b* and also into apertures of a spline sleeve 355 to connect the knob 348 and the spline sleeve 355. Fasteners 358 include O-rings 358*a* proximate the heads to seal the fasteners 358 and the cover 348*a*.

The spline sleeve 355 is positioned within cavities of the base 348*b* and a cylindrical member 360, and the spline sleeve 355 is also connected to the cylindrical member 360 with a fastener 359. The cylindrical member 360 includes an O-ring 360*a* to seal the cylindrical member 360 and the base 348*b*. A bottom knob gasket 365 is connected to the cylindrical member 360 with fasteners 366 to seal the cylindrical member 360 and the housing.

A fastener 356 has a spring 357 positioned around its shaft, and its shaft extends through a bore of the spline sleeve 355 and is connected to an end of a pinion gear 372. Fastener 359 extends through an aperture between the opposing apertures of the spline sleeve and into an aperture in the cylindrical member 360 and is configured and arranged to be received in a recessed portion of the housing when the descent assembly 345 is in select positions relative to the housing. Spring 357 exerts a biasing force against the spline sleeve 355, which moves the knob 348 and the spline sleeve 355 toward the housing. The cylindrical member 360 is fixed relative to the housing as it is attached with four fasteners 366 to the front plate 302. When positioned inwardly, the knob 348 is locked relative to the housing and cannot rotate. More specifically, the spline sleeve 355 engages the male spline portion of pinion gear 372 and the spline sleeve 355 engages the cylindrical member 360, which is fixed relative to the housing so that spline sleeve 355 cannot rotate and, thus, pinion gear 372 cannot rotate. When positioned outwardly, the knob 348 is free to rotate. More specifically, the knob 348 is free to rotate to an outward position and in this configuration, the spline sleeve 355 and the male spline portion of pinion gear 372 are not engaged and, thus, pinion gear 372 is free to rotate.

A spur gear 364 is operatively connected to the pinion gear 372 proximate the end opposite the spline sleeve 355. The end of the pinion gear 372 extends into a bearing 368 around which is an isolation disk 367 positioned in a bore of the housing. The isolation disk 367 reduces friction between the pinion gear 372 and the housing.

The spur gear 364 includes teeth which are configured and arranged to engage teeth of a gear operatively connected to the rotor 362. The rotor 362 is also configured and arranged to engage pawls 361. The rotor 362 and the pawls 361 are positioned within cavity 312*c*. The pawls include friction pads configured and arranged to contact sides of the housing when the pawls pivot outward. A fastener 370 extends through a bore of the rotor 362 and into a bore of a bushing 363. Fastener 370 is a shoulder screw that screws into the housing. The bushing 363 extends through the bore of the rotor 362 to reduce friction between the rotor 362, which rotates, and the fastener 370, which is secured to the housing. An isolation disk 371 reduces friction between the pawls 361 and the housing proximate the cavity 312*c*.

A brake assembly 380, an isolation disk 441, and a spring 442 are configured and arranged to be positioned within the cavity 312*a*. The brake assembly 380, which is of a type known in the art, includes a connecting plate 385 to which a cover 384 is connected with fasteners 385*a* and a ratchet cam gear 381 is connected with fasteners 385*b*. Between the connecting plate 385 and the ratchet cam gear 381 is an isolation disk 402. A ball bearing 386 is positioned about a protrusion (not shown) extending outward from the cover 384, and the ball bearing 386 assists in allowing smooth rotation of the cover 384, the connecting plate 385, the isolation disk 402, and the ratchet cam gear 381 about the hub of the brake assembly. The ratchet cam gear 381 includes an aperture 382 having inner teeth 382*a* and includes outer teeth 383. A connector 388 includes a base plate 391 to which pawls 405 and springs 410 are operatively connected. A hub portion 389 extends outward from the base plate 391, and an end of the hub portion 389 includes a threaded cylindrical portion 390. A bore extends through the connector 388.

Ratchet cam gear 381 combines a ratchet cam, which at least one of the pawls 405 engage when they pivot outward, and a gear, which engages teeth of the pinion gear 372. Because the ratchet cam gear 381 combines two components into one component, there are fewer components and thus the safety device weighs less, assembly is easier, and the cost is reduced.

A shaft 416 extends through the cavity 312*a*, through the bore 324, and into the cavity 314*a*. The shaft 416 is operatively connected to the connector 388 via a key 393 proximate one end of the shaft 416, an intermediate portion of the shaft 416 extends through the bore 324, and the other end of the shaft 416 extends into the cavity 314*a* proximate the side 314. The shaft 416 is substantially cantilevered within the housing, and the shaft 416 is rotatable. Positioned within the bore 324, a bearing 326 assists in supporting the shaft 416, a retaining ring 327 prevents bearing 326 from coming off of the housing, and a lip seal 330 seals the shaft 416 and the plate portion 323 to prevent moisture or other contaminants from entering the cavity 312*a* via bore 324. A drum 316 about which a lifeline 317 is wound is positioned within the cavity 314*a* proximate the side 314 and is operatively connected to the shaft 416. The spring 442 is positioned within the cavity 312*a* and is operatively connected to the shaft 416 to place a biasing force on the shaft 416 to wind cable about the drum. The isolation disk 441 is positioned about the shaft 416 proximate the spring 442. A washer 394 is positioned about the shaft 416, and the key 393 connects the shaft 416 to the connector 388 so that they rotate together. The connector 388 is operatively connected to the shaft 416.

The ratchet cam gear 381, the isolation disk 402, the connecting plate 385, and the cover 384 are operatively connected to the connector 388, and ball bearing 386 positioned within the bore of the connector 388 allows these components to rotate when the knob 348 is in an outward position. When the knob 348 is in an inward position, the spline sleeve 355 is fixed, and thus the pinion gear 372 and the ratchet cam gear 381 are fixed. When the shaft 416 rotates at a predetermined speed, the pawls 405 pivot outward and at least one pawl engages the inner teeth 382*a*, which prevents rotation of the shaft 416 when the knob 348 is in an inward position so that pinion gear 372 is locked.

When the knob 348 is in an outward position so that the pinion gear 372 is unlocked and free to rotate, the shaft 416 can still rotate but the rate of rotation is decreased due to the frictional forces of the pawls 361. Thus, the safety device 300 operates similarly to the safety device 100.

One of the advantages of the safety device 300 is that it includes a sealed housing portion, including the descent assembly 345, to prevent moisture and other contaminants from getting into the cavities 312*a*, 312*b*, and 312*c*. The seal members 302*a*, 348*c*, 358*a*, 360*a*, 365, and 330 assist in keeping moisture and other contaminants out of the cavities 312*a*, 312*b*, and 312*c*.

The above specification, examples, and data provide a complete description of the manufacture and use of the composition of embodiments of the invention. Since many embodiments of the invention can be made without departing from the spirit and scope of the invention, the invention resides in the claims hereinafter appended.

We claim:

1. A safety device having first and second operating modes, comprising:

a housing having a first cavity and a second cavity in fluid communication via a bore interconnecting the first and second cavities;

a drum rotatably operatively connected to the housing within the second cavity;

a lifeline having an intermediate portion interconnecting a first end and a second end, the first end being operatively connected to the drum;

a shaft operatively connected to the drum in the second cavity and extending through the bore and into the first cavity;

a first brake assembly operatively connected to the drum, the first brake assembly configured and arranged to frictionally control a payout of the lifeline, wherein the first brake assembly includes a first spur gear;

a second brake assembly operatively connected to the drum, the second brake assembly including a ratchet disk, at least one friction disk engaged with the ratchet disk, and a second spur gear engaged with the at least one friction disk;

at least one first pawl operatively connected to the drum and configured and arranged to engage the ratchet disk when the drum rotates at a predetermined rate of speed;

a pinion gear engaged with the second spur gear such that when the pinion gear rotates the second spur gear rotates and when the pinion gear does not rotate the second spur gear does not rotate; and a control operatively connected to the first brake assembly and having a first position and a second position, the first position selectively engaging the first brake assembly and the second position selectively disengaging the first brake assembly, wherein the control is further operatively connected to the second brake assembly, the first position setting a controlled descending mode that activates the first brake assembly by allowing the pinion gear to rotate in relation to the housing, rotation of the pinion gear further causing at least a portion of the second brake assembly to not be activated since the second spur gear rotates with the pinion gear, the second position setting a fall arrest mode that activates the second brake assembly by locking the pinion gear in relation to the housing such that when the at least one first pawl engages the ratchet disk the first spur gear prevents the drum from rotating in relation to the housing since the second spur gear is engaged with the pinion gear.

2. The safety device of claim 1, wherein at least a portion of the housing is sealed.

3. The safety device of claim 2, further comprising a first seal member positioned between the shaft and the housing within the bore, the first seal member sealing the first cavity from the second cavity, and at least one second seal member between the control and the housing.

4. The safety device of claim 3, further comprising a plate member configured and arranged to cover an opening in the housing providing access to the first cavity and a third seal positioned between the plate member and the housing.

5. The safety device of claim 1, wherein the first and second brake assemblies are operatively connected.

6. The safety device of claim 1, wherein the first brake assembly includes a rotor to which at least one second pawl having a friction pad is pivotally operatively connected, the friction pad contacting the housing when the rotor rotates to decrease a rotational rate of the rotor.

7. The safety device of claim 1, wherein the second brake assembly includes a gear assembly and the at least one first pawl, the at least one first pawl being configured and arranged to engage the gear assembly when the drum rotates at a predetermined speed.

8. The safety device of claim 7, wherein the gear assembly includes the ratchet disk that is configured and arranged to engage the at least one first pawl and the first brake assembly.

9. The safety device of claim 8, wherein the second spur gear interconnects the second brake assembly and the first brake assembly.

10. The safety device of claim 1, wherein the first brake assembly includes a rotor to which at least one second pawl having a friction pad is pivotally operatively connected, the rotor including a gear, the first spur gear having inner teeth and outer teeth, the inner teeth mating with the first teeth of a shaft connecting the first and second brake assemblies and the control and the outer teeth mating with the gear of the rotor to interconnect the shaft and the rotor, the friction pad contacting the housing when the rotor rotates to decrease a rotational rate of the rotor.

11. The safety device of claim 1, wherein the control is sealed.

12. The safety device of claim 1, wherein at least a portion of the housing is sealed.

13. The safety device of claim 1, wherein the second brake assembly is configured and arranged to be used during a fall event.

14. The safety device of claim 13, wherein the second position comprises selectively engaging the second brake assembly.

* * * * *